US009242819B2

(12) United States Patent
Takezawa

(10) Patent No.: US 9,242,819 B2
(45) Date of Patent: Jan. 26, 2016

(54) SHEET CONVEYANCE APPARATUS ENSURING REDUCED DAMAGE OF STOPPER

(71) Applicant: Kyocera Document Solutions Inc., Osaka (JP)

(72) Inventor: Mashio Takezawa, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/525,225

(22) Filed: Oct. 28, 2014

(65) Prior Publication Data

US 2015/0115519 A1 Apr. 30, 2015

(30) Foreign Application Priority Data

Oct. 28, 2013 (JP) ..... 2013-223096

(51) Int. Cl.

*B65H 3/06* (2006.01)
*B65H 3/56* (2006.01)
*B65H 3/34* (2006.01)

(52) U.S. Cl.

CPC ..... *B65H 3/34* (2013.01); *B65H 3/0669* (2013.01); *B65H 3/0684* (2013.01); *B65H 3/56* (2013.01); *B65H 2402/441* (2013.01); *B65H 2403/22* (2013.01); *B65H 2403/53* (2013.01); *B65H 2403/721* (2013.01); *B65H 2404/6111* (2013.01); *B65H 2405/3321* (2013.01); *B65H 2801/06* (2013.01); *B65H 2801/39* (2013.01)

(58) Field of Classification Search

CPC ..... B65H 3/0684; B65H 3/0669; B65H 3/56
See application file for complete search history.

(56) References Cited

U.S. PATENT DOCUMENTS

| | | | | |
|---|---|---|---|---|
| 6,991,227 | B2 * | 1/2006 | Kim | 271/10.12 |
| 7,320,462 | B2 * | 1/2008 | Takamatsu | 271/3.14 |
| 8,322,708 | B2 * | 12/2012 | Liu | 271/124 |
| 8,382,095 | B2 * | 2/2013 | Osanai et al. | 271/124 |
| 8,970,855 | B2 * | 3/2015 | Muraoka | 358/1.12 |
| 2004/0071486 | A1 * | 4/2004 | Manabe et al. | 399/367 |

FOREIGN PATENT DOCUMENTS

JP 2011-213447 A 10/2011

* cited by examiner

*Primary Examiner* — Luis A Gonzalez
(74) *Attorney, Agent, or Firm* — James W. Judge

(57) ABSTRACT

A sheet conveyance apparatus includes a sheet conveyance path, a sheet feeding member, a driving mechanism, a stopper, an interlocking portion, a cover member, and an evacuation mechanism. The stopper is configured to change a posture between a projection posture and an evacuation posture. The projection posture is configured to project into the sheet conveyance path so as to prevent the sheet to be loaded on a sheet loading portion from abutting on the sheet feeding member. The evacuation posture is configured to evacuate the stopper from the sheet conveyance path. The evacuation mechanism is configured to: change the stopper to have the evacuation posture, or to be in a posture changeable state where the stopper changes from the projection posture to the evacuation posture by application of external force, in conjunction with a change of the cover member from a closed state to the open state.

10 Claims, 26 Drawing Sheets

SHEET CONVEYANCE APPARATUS ENSURING REDUCED DAMAGE OF STOPPER

INCORPORATION BY REFERENCE

This application is based upon, and claims the benefit of priority from, corresponding Japanese Patent Application No. 2013-223096 filed in the Japan Patent Office on Oct. 28, 2013, the entire contents of which are incorporated herein by reference.

BACKGROUND

Unless otherwise indicated herein, the description in this section is not prior art to the claims in this application and is not admitted to be prior art by inclusion in this section.

As a sheet conveyance apparatus that conveys sheets, there is provided an automatic document feeding apparatus arranged at an automatic document reading unit of an image forming apparatus. This automatic document feeding apparatus includes a paper feeding unit. The paper feeding unit is arranged opposed to a plurality of documents (bundle of documents) to be loaded. The paper feeding unit includes pickup rollers and a feed roller. When the pickup rollers send out the documents, the feed roller conveys one sheet of the document uppermost of the documents to a downstream in a sheet conveyance direction.

If a bundle of document is inserted to the position opposed to the paper feeding unit among the automatic document feeding apparatus with strong power, the plurality of sheets of documents are sandwiched at a periphery of the feed roller. As a result, this prevents the feed roller from sending out the documents one by one. There is disclosed stoppers that project to a sheet conveyance path between the pickup rollers and the feed roller to prevent an entrance of a document to the periphery of the feed roller when the documents are placed. The stoppers are turnably supported to a cover member of the automatic document feeding apparatus. The stoppers are secured to regulating positions by abutting on fixing members arranged at the cover member. The stoppers regulate the document at the regulating positions.

SUMMARY

A sheet conveyance apparatus according to one aspect of the disclosure includes a housing, a sheet loading portion, a sheet conveyance path, a sheet feeding member, a driving mechanism, a stopper, an interlocking portion, a cover member, and an evacuation mechanism. The sheet loading portion is arranged at the housing. A sheet is to be loaded on the sheet loading portion. The sheet conveyance path extends from the sheet loading portion in the housing. The sheet is to be conveyed in a predetermined conveyance direction through the sheet conveyance path. The sheet feeding member is arranged at an inlet side of the sheet conveyance path. The sheet feeding member is configured to convey the sheet by being rotated. The driving mechanism is configured to rotate the sheet feeding member. The stopper is configured to change a posture between a projection posture and an evacuation posture at an upstream with respect to the sheet feeding member in the conveyance direction. The projection posture is configured to project into the sheet conveyance path so as to prevent the sheet to be loaded on the sheet loading portion from abutting on the sheet feeding member. The evacuation posture is configured to evacuate the stopper from the sheet conveyance path. The interlocking portion is configured to fix the stopper to the projection posture or the evacuation posture in conjunction with the rotation of the sheet feeding member. The cover member supports the sheet feeding member and the stopper. The cover member is openable/closable to the housing. The cover member in an open state opens the sheet conveyance path to an outside of the housing. The evacuation mechanism is configured to: change the stopper to have the evacuation posture, or to be in a posture changeable state where the stopper changes from the projection posture to the evacuation posture by application of external force, in conjunction with a change of the cover member from a closed state to the open state.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
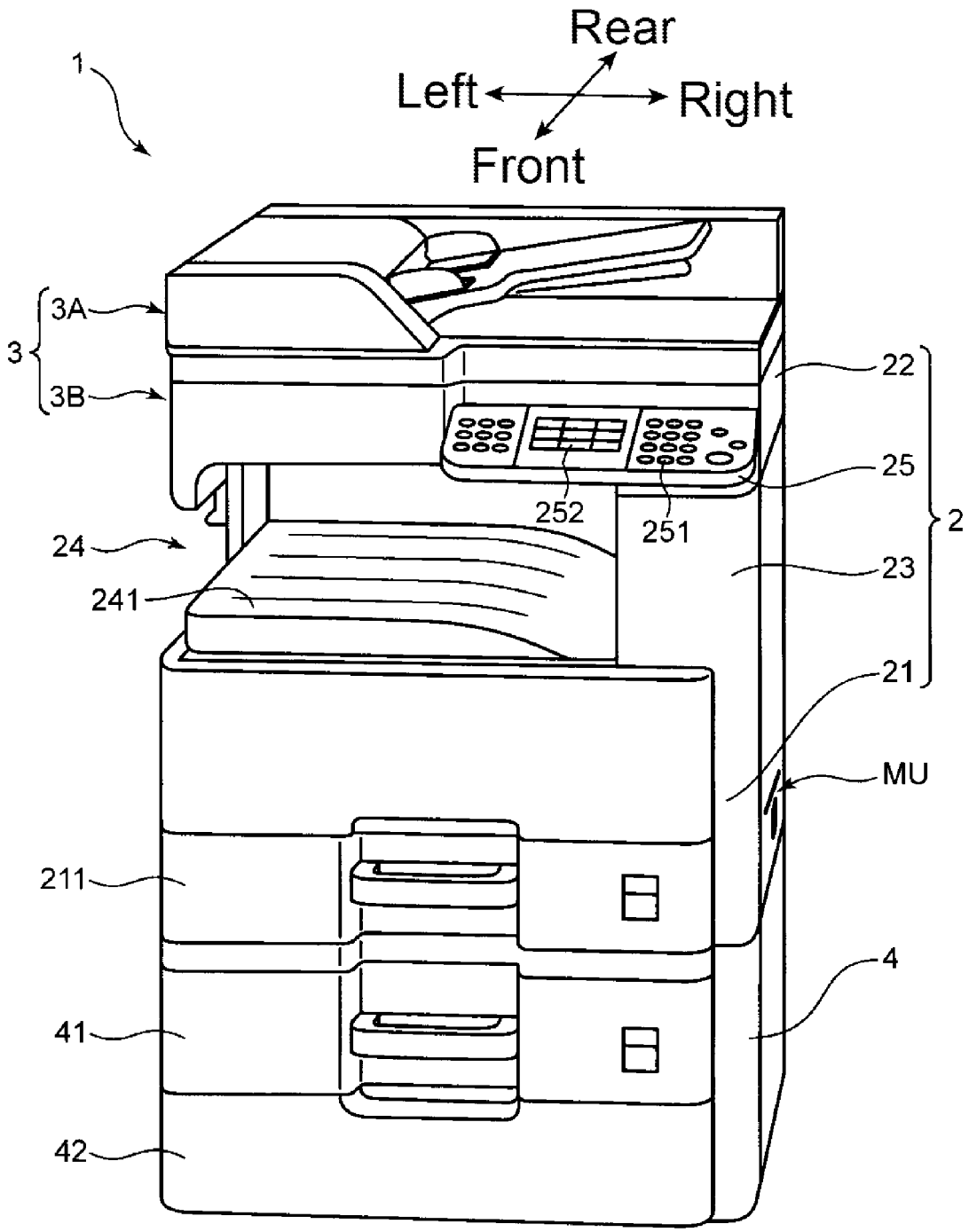
FIG. 1 perspectively illustrates an image forming apparatus according to the one embodiment.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
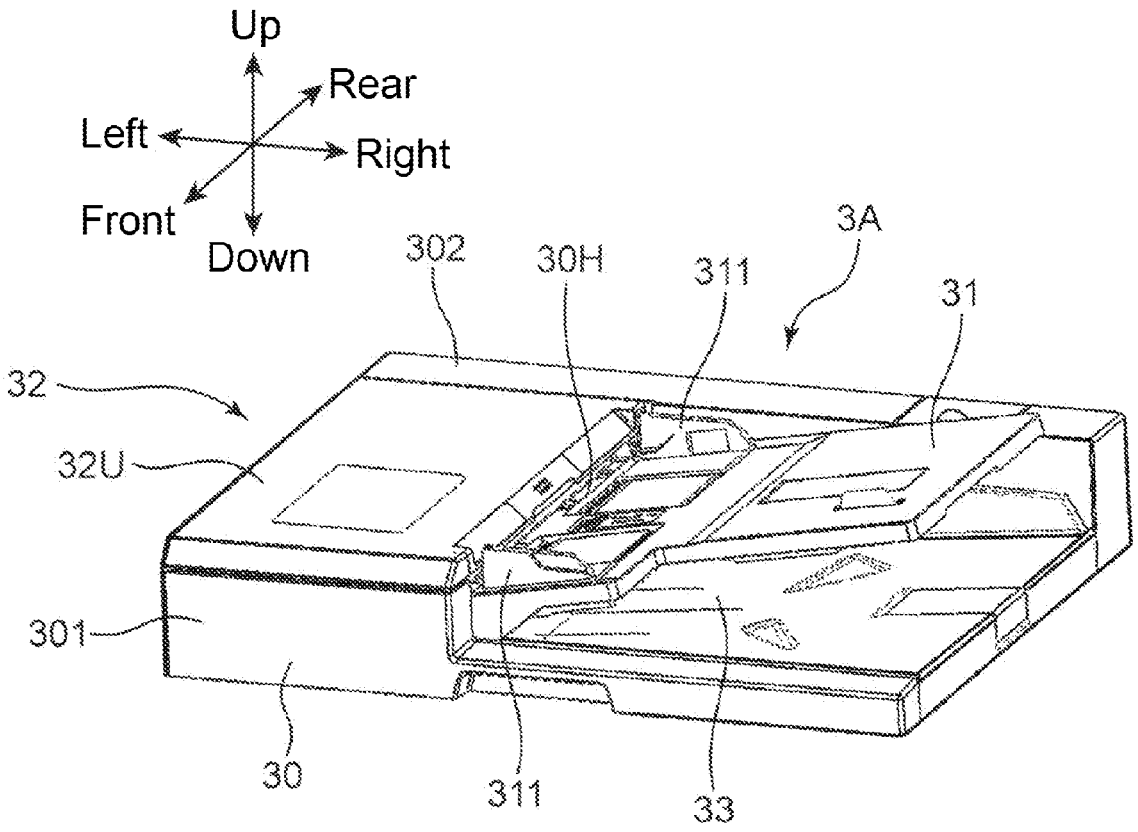
FIG. 2 perspectively illustrates an automatic document feeding apparatus according to the one embodiment.
Figure 3:
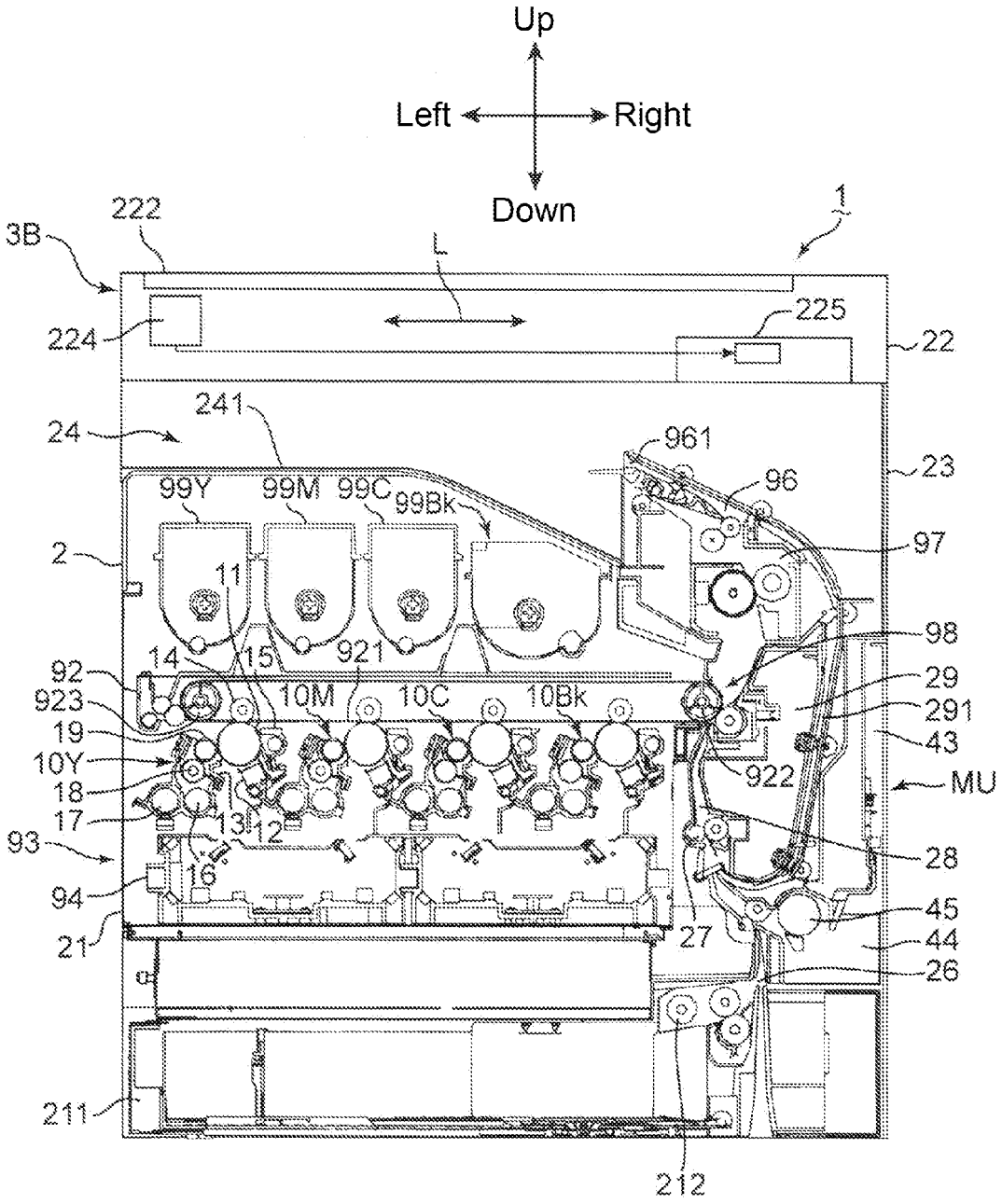
FIG. 3 illustrates a cross section of an internal structure of the image forming apparatus according to the one embodiment.
Figure 4:
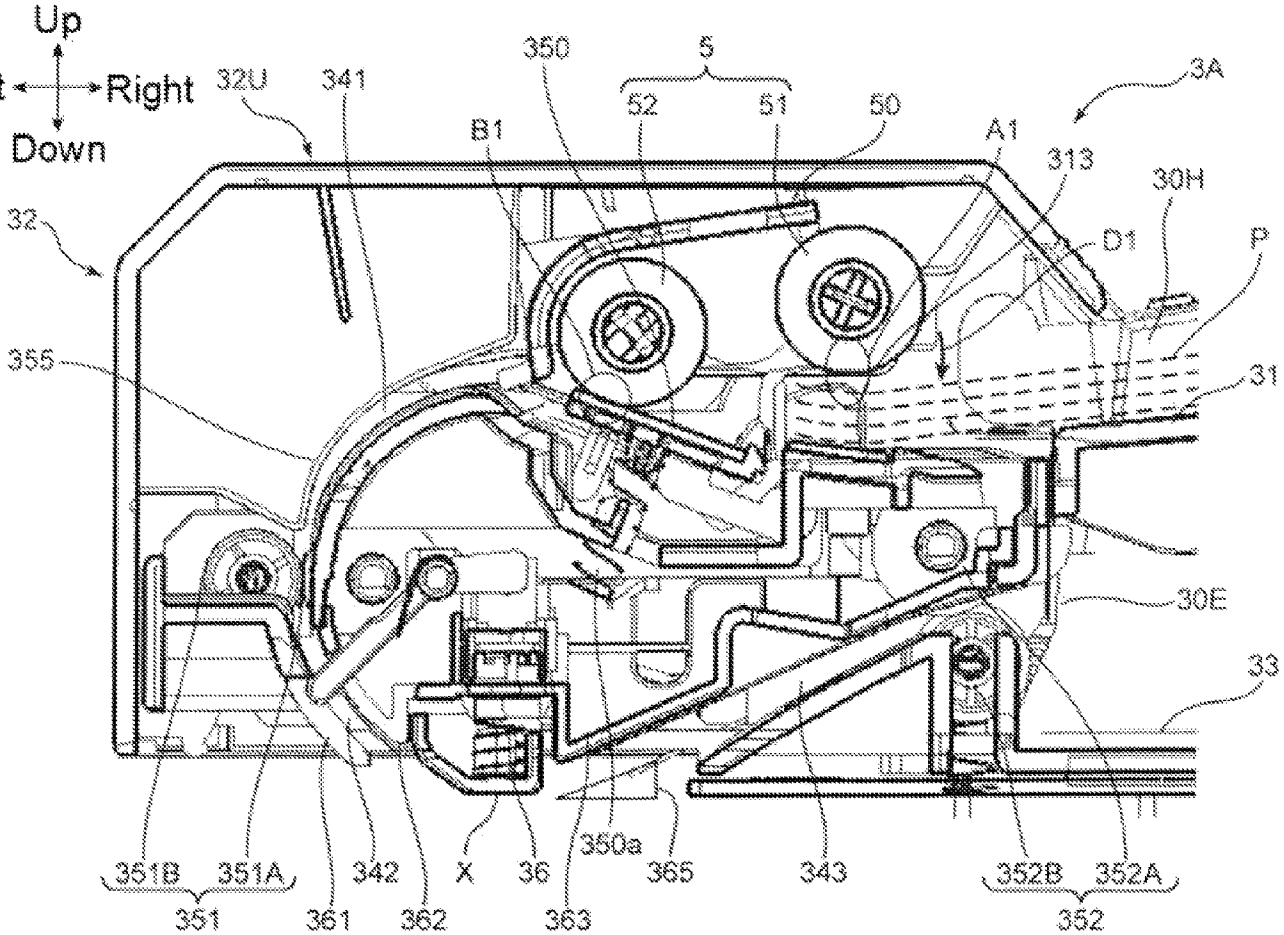
FIG. 4 illustrates a cross section of a document conveying unit, which is a main part of the automatic document feeding apparatus according to the one embodiment.

The following describes embodiments of the disclosure in detail based on the drawings. FIG. 1 perspectively illustrates an external appearance of an image forming apparatus 1 that includes an automatic document feeding apparatus 3A (sheet conveyance apparatus) and an image reading apparatus 3 according to one embodiment of the disclosure. FIG. 2 perspectively illustrates an external appearance of the automatic document feeding apparatus 3A. FIG. 3 illustrates a cross section of an internal structure of the image forming apparatus 1. FIG. 4 illustrates a cross section of a document conveying unit 32, which is a main part of the automatic document feeding apparatus 3A. Here, as the image forming apparatus 1, an exemplary copier of in-barrel paper discharge type is described. However, the image forming apparatus may be a printer, a facsimile device, or a multi-functional peripheral that has these functions.

The image forming apparatus 1 includes an apparatus main body 2, an automatic document feeding apparatus 3A, and an additional paper feeding unit 4. The apparatus main body 2 has a housing structure of approximately rectangular parallelepiped shape and has an in-barrel space. The automatic document feeding apparatus 3A is arranged at the top surface of the apparatus main body 2. The additional paper feeding unit 4 is assembled to a lower side of the apparatus main body 2.

The apparatus main body 2 forms images on sheets. The apparatus main body 2 includes a lower chassis 21, an upper chassis 22, and a connection chassis 23. The lower chassis 21 has an approximately rectangular parallelepiped shape. The upper chassis 22 has an approximately rectangular parallelepiped shape and is installed at an upper side of the lower chassis 21. The connection chassis 23 connects the lower chassis 21 to the upper chassis 22. The lower chassis 21 houses various devices for image formation. The upper chassis 22 houses an image reading unit 3B (reading unit). The image reading unit 3B optically reads document images. The automatic document feeding apparatus 3A and the image reading unit 3B constitute the image reading apparatus 3. The in-barrel space surrounded by the lower chassis 21, the upper chassis 22, and the connection chassis 23 is an in-barrel paper discharge unit 24. The in-barrel paper discharge unit 24 can house the sheets after image formation. The connection chassis 23 houses a discharge port 961 (see FIG. 3). The discharge port 961 is arranged at a right-side surface side of the apparatus main body 2 and discharges the sheets to the in-barrel paper discharge unit 24.

The in-barrel space used as the in-barrel paper discharge unit 24 is open to the outside of the front surface and a left side surface of the apparatus main body 2. A user can insert his/her hand from these open areas to take out the sheets after the image formation from the in-barrel paper discharge unit 24. A bottom surface 241 of the in-barrel space is partitioned at the top surface of the lower chassis 21. The sheets discharged from the discharge port 961 are loaded on the bottom surface 241.

An operation panel unit 25 projects from a front surface of the upper chassis 22. The operation panel unit 25 includes an operation key 251, an LCD touch panel 252, or a similar member. The operation key 251 includes a numeric keypad, a start key, or a similar key. The operation panel unit 25 accepts inputs of various operations and instructions from the user. The user can input the number of printed sheets or similar information and input a print density or a similar condition through the operation panel unit 25.

A sheet feed cassette 211 is mounted to the lower chassis 21. The sheet feed cassette 211 houses recording sheets to be image formed. The additional paper feeding unit 4 also includes sheet feed cassettes 41 and 42. The sheet feed cassettes 41 and 42 house the recording sheets to be image formed. These sheet feed cassettes 211, 41, and 42 are cassettes disposed for automatic paper feed and can house a large amount of recording sheets depending on their sizes. The sheet feed cassette 211, 41, and 42 can be pulled out from the front surface of the lower chassis 21 or the additional paper feeding unit 4 to the near direction. FIG. 3 illustrates only the sheet feed cassette 211 in the lower chassis 21.

A multi-tray unit MU is mounted at a right-side surface of the apparatus main body 2. The multi-tray unit MU causes the user to manually feed paper sheets. The multi-tray unit MU includes a sheet feed tray 43 and a paper feeding unit 44 (see FIG. 3). The recording sheets are manually placed on the sheet feed tray 43. The paper feeding unit 44 carries in the recording sheets to an image forming unit inside of the lower chassis 21. A lower end portion of the sheet feed tray 43 is openably/closably mounted to the lower chassis 21 and is closed while not in use. To manually feed paper sheets, the user opens the sheet feed tray 43 and places the recording sheets on the sheet feed tray 43.

The automatic document feeding apparatus 3A is turnably mounted to a rear side of the top surface of the upper chassis 22 of the apparatus main body 2. FIG. 3 omits illustration of the automatic document feeding apparatus 3A. The automatic document feeding apparatus 3A automatically feeds a document sheet to be copied to a predetermined document reading position at the apparatus main body 2 while abutting on the top surface of the upper chassis 22. On the other hand, when the user manually places the document sheet at the predetermined document reading position, the user opens the automatic document feeding apparatus 3A upward.

With reference to FIG. 2, the automatic document feeding apparatus 3A includes a main body housing 30 (housing), a document feed tray 31 (sheet loading portion), the document conveying unit 32, and a document discharge tray 33. The main body housing 30 is a housing that houses various mechanisms provided to the automatic document feeding apparatus 3A. The automatic document feeding apparatus 3A includes a front wall portion 301 and a rear wall portion 302 at a left side part housing the document conveying unit 32 and an approximately flat low layer part at a right side part. The front wall portion 301 and the rear wall portion 302 protrude upward. The rear wall portion 302 is a wall portion of approximately same height along a length of the automatic document feeding apparatus 3A in a lateral direction.

The document feed tray 31 is arranged at the main body housing 30. The document feed tray 31 is a tray to which the document sheets to be fed to an image reading position are loaded. The document feed tray 31 is attached to the main body housing 30 so as to extend from a feeding port 30H of the main body housing 30. The document feed tray 31 includes a pair of cursors 311. The pair of cursors 311 adjust widths of the placed document sheets.

The document conveying unit 32 includes a conveyance path and a conveying mechanism. The conveyance path and the conveying mechanism convey the document sheets on the document feed tray 31 to the document discharge tray 33 via the image reading position. The document conveying unit 32 includes an upper cover unit 32U (cover member), which is engaged into an opening between the front wall portion 301 and the rear wall portion 302 of the main body housing 30. Details of these components are described later with reference to FIG. 4.

The document discharge tray 33 is a tray to which the document sheets from which document images have been optically read are discharged. The document discharge tray 33 is disposed at the top surface of the low layer part at the right side of the main body housing 30.

Next, with reference to FIG. 3, the following describes an internal structure of the apparatus main body 2. The lower chassis 21 internally houses, in an order from upward, toner containers 99Y, 99M, 99C, and 99Bk, an intermediate transfer unit 92, an image forming unit 93, an exposure unit 94, and the above-described sheet feed cassette 211.

The image forming unit 93 forms images on the sheet according to the document images read by the image reading unit 3B. The image forming unit 93 includes four image forming units 10Y, 10M, 10C, and 10Bk for forming full-color toner images. The image forming units 10Y, 10M, 10C, and 10Bk form toner images with yellow (Y), magenta (M), cyan (C), and black (Bk), respectively. The image forming units 10Y, 10M, 10C, and 10Bk each include a photoreceptor drum 11, a charger 12, a developing device 13, a primary transfer roller 14, and a cleaning apparatus 15 arranged at the peripheral area of the photoreceptor drum 11.

The photoreceptor drum 11 rotates around its axis. On a circumference surface of the photoreceptor drum 11, an electrostatic latent image and a toner image are formed. As the photoreceptor drum 11, a photoreceptor drum using an amorphous silicon (a-Si)-based material can be employed. The charger 12 uniformly charges the surface of the photoreceptor drum 11. After the charge, the exposure unit 94 exposes the circumference surface of the photoreceptor drum 11, thus forming the electrostatic latent image.

The developing device 13 supplies the toner to the circumference surface of the photoreceptor drum 11 so as to develop the electrostatic latent image formed on the photoreceptor drum 11. The developing device 13 is for two-component developer and includes agitation rollers 16 and 17, a magnetic roller 18, and a developing roller 19. The agitation rollers 16 and 17 circulatively convey the two-component developer while agitating it, so as to charge the toner. On the circumference surface of the magnetic roller 18, a two-component developer layer is supported. On the circumference surface of the developing roller 19, a toner layer is supported. The toner layer is formed by delivery and receipt of the toner due to the difference in electric potential between the magnetic roller 18 and the developing roller 19. The toner on the developing roller 19 is supplied to the circumference surface of the photoreceptor drum 11, so as to develop the electrostatic latent image.

The primary transfer roller 14 sandwiches an intermediate transfer belt 921 included in the intermediate transfer unit 92 so as to form a nip portion together with the photoreceptor drum 11, and primarily transfers the toner image on the photoreceptor drum 11 onto the intermediate transfer belt 921. The cleaning apparatus 15 cleans the circumference surface of the photoreceptor drum 11 after transferring the toner image.

The yellow toner container 99Y, the magenta toner container 99M, the cyan toner container 99C, and the black toner container 99Bk reserve toners of respective colors. The toners of the respective colors are supplied through a supply path (not illustrated) to the developing devices 13 of the image forming units 10Y, 10M, 10C, and 10Bk corresponding to the respective colors of Y, M, C, and Bk.

The exposure unit 94 includes various kinds of optical system apparatuses, for example, a light source, a polygon mirror, a reflective mirror, and a deflecting mirror. The exposure unit 94 irradiates the light based on the image data of the document image to the respective circumference surfaces of the photoreceptor drums 11 disposed in the image forming units 10Y, 10M, 10C, and 10Bk, so as to form the electrostatic latent image.

The intermediate transfer unit 92 includes the intermediate transfer belt 921, a drive roller 922, and a driven roller 923. On the intermediate transfer belt 921, toner images from the plurality of photoreceptor drums 11 are superimposed (in primary transfer). The superimposed toner images are secondarily transferred to a recording sheet to be supplied from the sheet feed cassette 211 in a secondary transfer unit 98. The drive roller 922 and the driven roller 923 that circularly drive the intermediate transfer belt 921 are rotatably supported by the lower chassis 21.

The sheet feed cassette 211 (41 and 42) houses a sheet bundle formed by laminating the plurality of recording sheets. In the upper portion of the sheet feed cassette 211 on the right end side, a feeding roller 212 is arranged. Driving the feeding roller 212 feeds the recording sheet in the uppermost layer of the sheet bundle within the sheet feed cassette 211 one by one, so as to carry the fed recording sheet in a carry-in conveyance path 26. On the other hand, the recording sheet manually placed on the sheet feed tray 43 is carried in the carry-in conveyance path 26 by the driving of a conveyance roller 45 of the paper feeding unit 44.

At the downstream side of the carry-in conveyance path 26, a conveyance path 28 is disposed. The conveyance path 28 is extended to the discharge port 961 via the secondary transfer unit 98, a fixing unit 97, and a sheet discharge unit 96, which will be described later. The upstream portion of the conveyance path 28 is formed between the inner wall formed in the lower chassis 21 and the inner wall forming the internal surface of a reverse conveying unit 29. Here, the outer surface of the reverse conveying unit 29 forms one surface of an inverting conveyance path 291 where a sheet is inversely conveyed at the time of duplex printing. At the upstream side of the secondary transfer unit 98 in the conveyance path 28, a registration roller pair 27 is arranged. The sheet is once stopped by the registration roller pair 27 for skew correction. Subsequently, the sheet is sent out to the secondary transfer unit 98 at predetermined timing for image transfer.

The connection chassis 23 houses the fixing unit 97 and the sheet discharge unit 96 inside. The fixing unit 97 includes a fixing roller and a pressure roller. In the secondary transfer unit 98, the fixing unit 97 heats and applies pressure to the recording sheet on which the toner image has been secondarily transferred, so as to perform a fixing process. The recording sheet with the color image after the fixing process is discharged from the discharge port 961 toward the in-barrel paper discharge unit 24 by the sheet discharge unit 96 arranged downstream with respect to the fixing unit 97.

The above-described image reading unit 3B is installed at the upper chassis 22. The image reading unit 3B is arranged opposed to the image reading position arranged between a second conveyance path 342 and a third conveyance path 343 of the automatic document feeding apparatus 3A, which will be described later. The image reading unit 3B reads the document image on the document sheet. The image reading unit 3B includes an exposure glass 222, a CIS unit 224, and an image processing unit 225. The exposure glass 222 is opposed to the document sheet automatically fed from the automatic document feeding apparatus 3A and a fixed document placed on the top surface of the exposure glass 222 with its document surface faced downward. The exposure glass 222 becomes a reading surface on which these document images are to be read.

The CIS unit 224 optically reads the document images on the document sheets. The CIS unit 224 extends in a front-rear direction (main-scanning direction) and is movable in the lateral direction (sub-scanning direction) by transportation means (not illustrated). The CIS unit 224 includes an LED light source (not illustrated), a graded-index (GRIN) lens, and a contact image sensor (CIS). Reflected light from the document lit by the LED light source is photoelectrically converted by linearly installed CISs via the GRIN lenses arranged in an array shape, thus the image on the document is read. The image data of the document images photoelectrically converted by the CISs are sent to the image processing unit 225. The image processing unit 225 performs various image processing on the image data according to a reading condition of the document image, and then sends the processed image data to the exposure unit 94.

Next, with reference to FIG. 4, the following describes the internal structure of the automatic document feeding apparatus 3A in detail. FIG. 4 illustrates a cross section of the document conveying unit 32 that is a main part of the automatic document feeding apparatus 3A. The document conveying unit 32 includes first to third conveyance paths 341 to 343 (sheet conveyance paths), a first conveyance roller pair 351 and a second conveyance roller pair 352, and a document feeding unit 5. The first to third conveyance paths 341 to 343 serve as conveying paths of a document sheet P. The first conveyance roller pair 351 and the second conveyance roller pair 352 are arranged at appropriate positions in the first to third conveyance paths 341 to 343. The document feeding unit 5 sends the document sheet placed on the document feed tray 31 into the document conveying unit 32.

The first, second, and third conveyance paths 341, 342, and 343 are sheet conveyance paths extending from the above-described document feed tray 31. Through the first, second, and third conveyance paths 341, 342, and 343, the document sheets P are conveyed in the predetermined conveyance direction. More specifically, the first, second, and third conveyance paths 341, 342, and 343 extend from the feeding port 30H via an optical document reading position X for document image to a sheet discharge exit 30E, thus constituting a sheet conveyance path curved into a U-shape. The sheet discharge exit 30E discharges the document sheet P to the document discharge tray 33.

The first conveyance path 341 is a conveyance path continuous from the document feed tray 31 and has an approximately circular arc shape from the feeding port 30H to the left side and extends slightly downward to the first conveyance roller pair 351. The first conveyance path 341 is a conveyance path through which the document sheet P sent out from the document feeding unit 5 first passes. A first guiding member 355 of the upper cover unit 32U defines an upper conveying surface of the first conveyance path 341.

The second conveyance path 342 is an arc-like conveyance path extending from a downstream end of the first conveyance path 341 to a position opposed to a facing surface guide 36, which forms the document reading position X. The facing surface guide 36 is arranged opposed to the exposure glass 222 (see FIG. 3) and forms the document reading position X in between the exposure glass 222. The arc-like second guiding member 361 defines the lower conveying surface of the second conveyance path 342. The arc-like third guiding member 362 defines the upper conveying surface of the second conveyance path 342. The guiding member 362 is arranged opposed to the second guiding member 361.

The third conveyance path 343 is a conveyance path extending rightward from the position opposed to the facing surface guide 36 slightly upward to the sheet discharge exit 30E. A document discharge guide 365, which will be described later, and a fourth guiding member 363 define an inlet side of the third conveyance path 343. The document discharge guide 365 is installed on the exposure glass 222. The fourth guiding member 363 is arranged opposed to and upward of the document discharge guide 365.

The document feeding unit 5 is arranged at the inlet side of the first conveyance path 341. The document feeding unit 5 is built into a bottom surface of the upper cover unit 32U. The document feeding unit 5 includes a holder 50, a pickup roller 51, and a feed roller 52 (sheet feeding member). The holder 50 supports respective components. The feed roller 52 is arranged at a downstream with respect to the pickup roller 51 in a sheet conveyance direction providing a predetermined distance from the pickup roller 51.

The pickup roller 51 is arranged upward of a distal end portion (left end portion) of the document feed tray 31. A motor 400, which will be described later, rotates the pickup roller 51. The pickup roller 51 sends out the document sheet P placed on the document feed tray 31 to the feed roller 52, which is located at the downstream side in the sheet conveyance direction. As illustrated in FIG. 4, an opposed pad 313 is arranged at a position opposed to the pickup roller 51 in the distal end portion of the document feed tray 31 of the main body housing 30. The pickup roller 51 is moved in an arrow D1 direction so as to abut on the document sheet P. A nip portion A1 is formed between the pickup roller 51 and the opposed pad 313. The document sheet P is sandwiched at the nip portion A1. After terminating a paper feeding operation of the document sheet P, the pickup roller 51 moves upward so as to be separate from the document sheet P again. The moving operation of the pickup roller 51 will be described in detail later.

The feed roller 52 is arranged at the inlet side of the first conveyance path 341. The motor 400, which will be described later, rotates the feed roller 52. The feed roller 52 further conveys the document sheet sent out from the pickup roller 51 one by one to the downstream in the sheet conveyance direction. As illustrated in FIG. 4, in the main body housing 30, a separation pad 350 is arranged opposed to and downward of the feed roller 52. A spring member 350*a* is arranged at further downward of the separation pad 350. The spring member 350*a* pushes the separation pad 350 upward. The pressing force by the spring member 350*a* forms a nip portion B1 between the feed roller 52 and the separation pad 350.

The first conveyance roller pair 351 is formed of a combination of a drive roller 351A and a driven roller 351B. The second conveyance roller pair 352 is formed of a combination of a drive roller 352A and a driven roller 352B. Rotary drive power for conveying the document sheet is transmitted to rotate the drive rollers 351A and 352A. The driven rollers 351B and 352B abut on the drive rollers 351A and 352A so as to be drivingly rotated, respectively.

The first conveyance roller pair 351 is arranged between the first conveyance path 341 and the second conveyance path 342. The first conveyance roller pair 351 feeds the document sheet sent out from the document feeding unit 5 to the document reading position X. The second conveyance roller pair 352 is installed at a terminating end of the third conveyance path 343. The second conveyance roller pair 352 feeds the document sheet P that has been read at the document reading position X from the sheet discharge exit 30E to the document discharge tray 33.

The above-described upper cover unit 32U (see FIGS. 2 and 4) supports the document feeding unit 5, which will be described later, and is openable/closable to the main body housing 30. While the upper cover unit 32U is open, the upper cover unit 32U opens the first conveyance path 341 and the second conveyance path 342 to the outside of the main body housing 30. Consequently, if the document sheet becomes stuck at the first conveyance path 341 and the second conveyance path 342, the document sheet can be removed.

Figure 5:
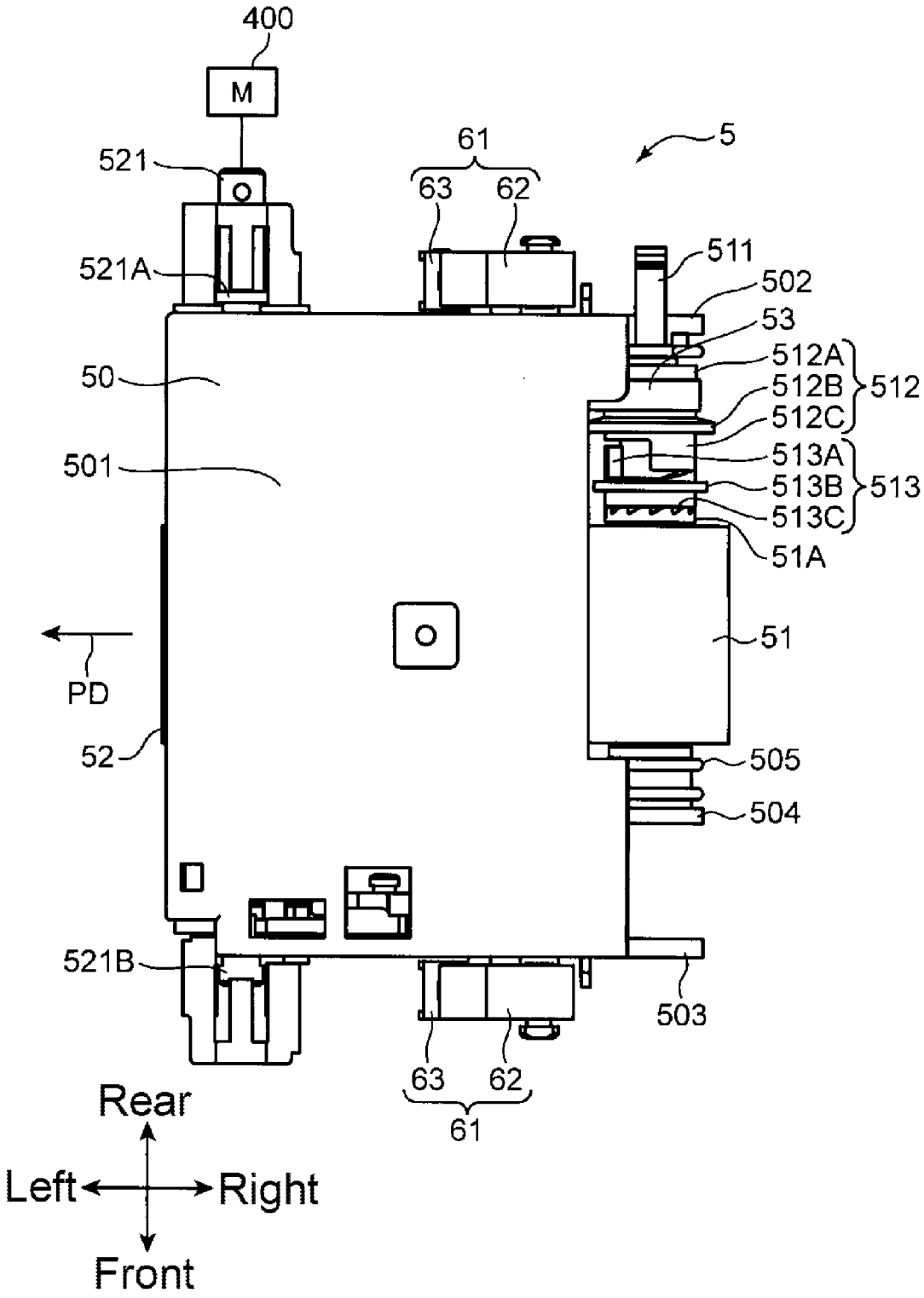
FIG. 5 illustrates a document feeding unit according to the one embodiment.
Figure 6A:
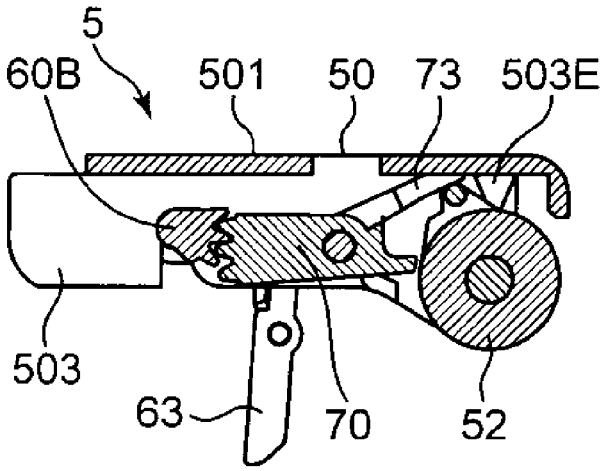
FIG. 6A illustrates a cross section of the document feeding unit according to the one embodiment.
Figure 6B:
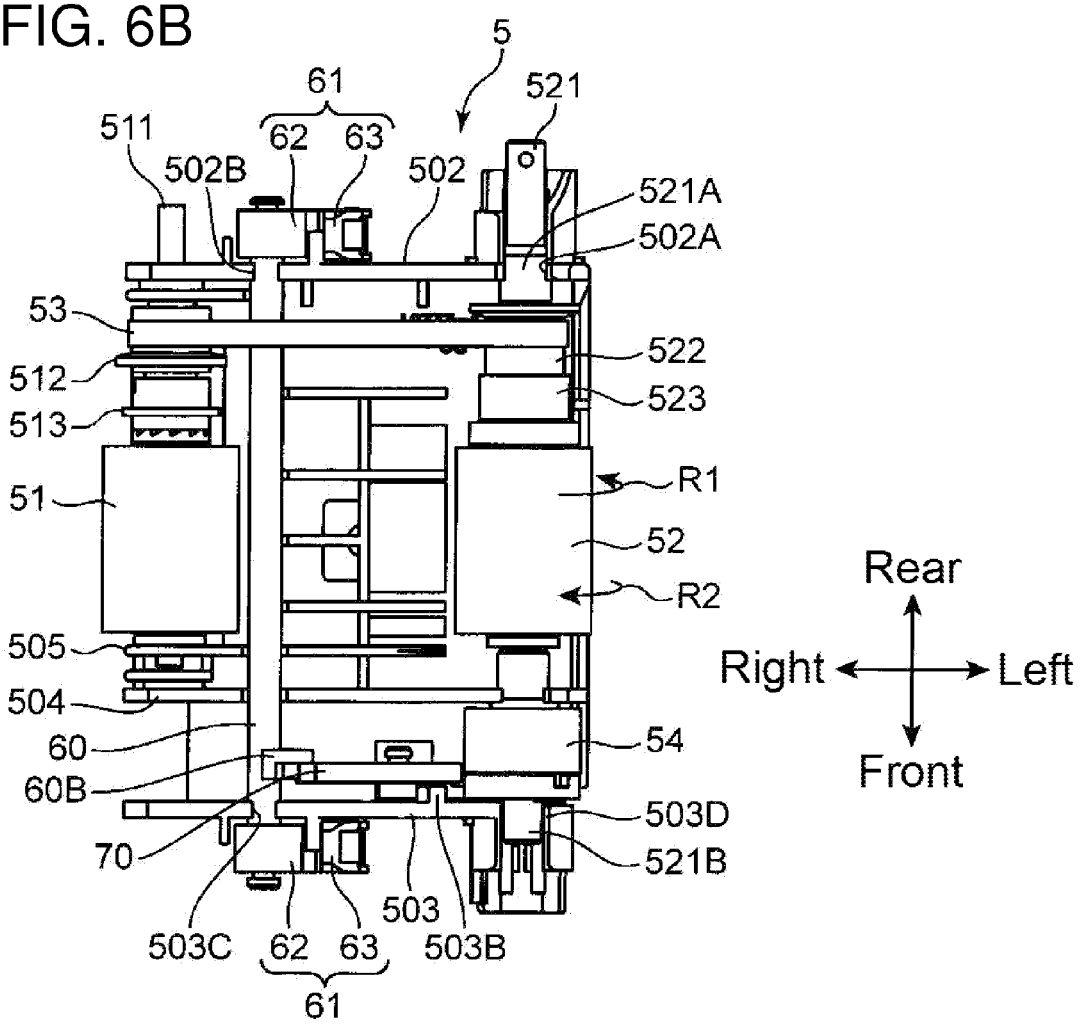
FIG. 6B illustrates a bottom view of the document feeding unit according to the one embodiment.
Figure 7:
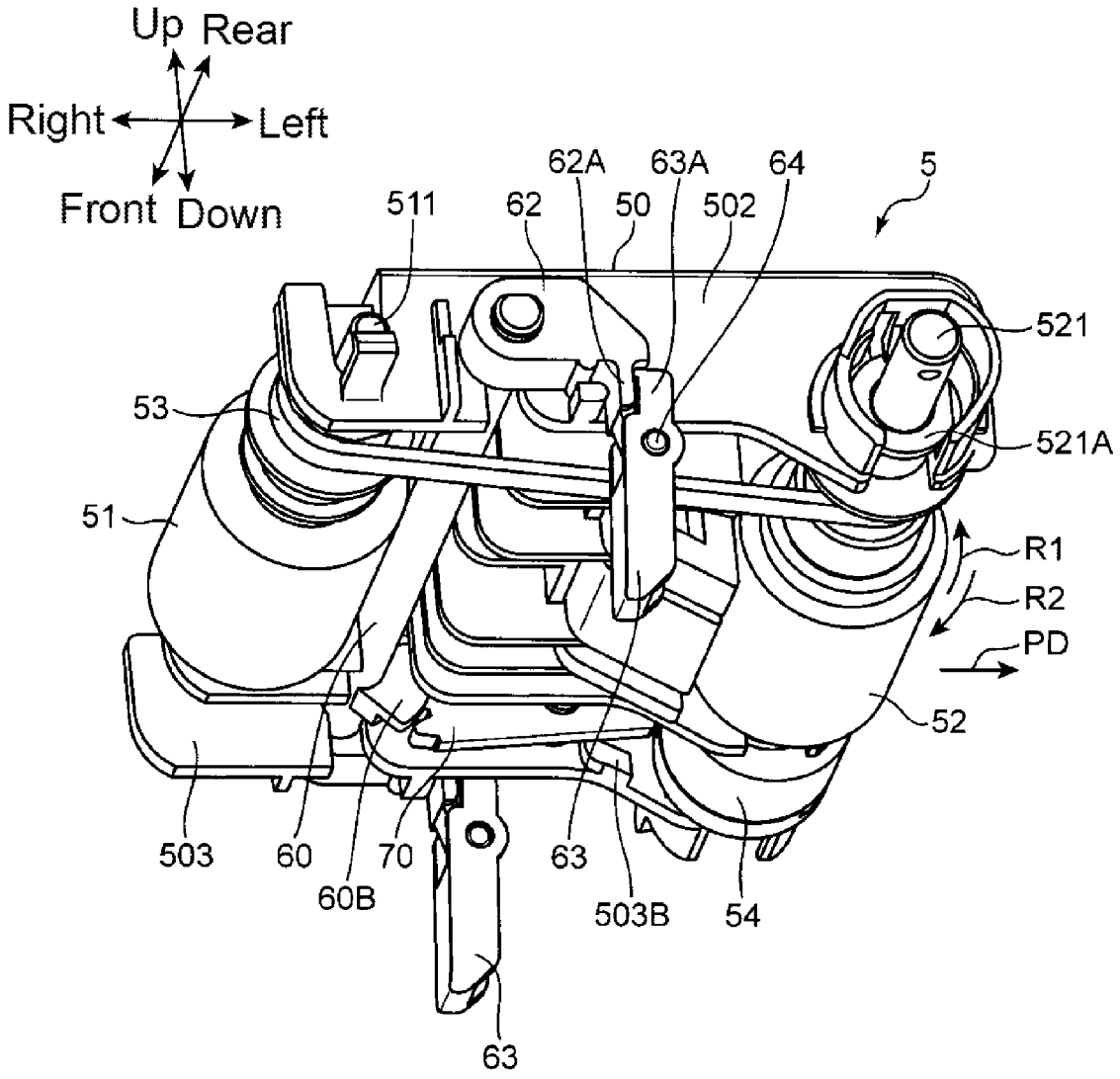
FIG. 7 perspectively illustrates the document feeding unit according to the one embodiment.
Figure 8:
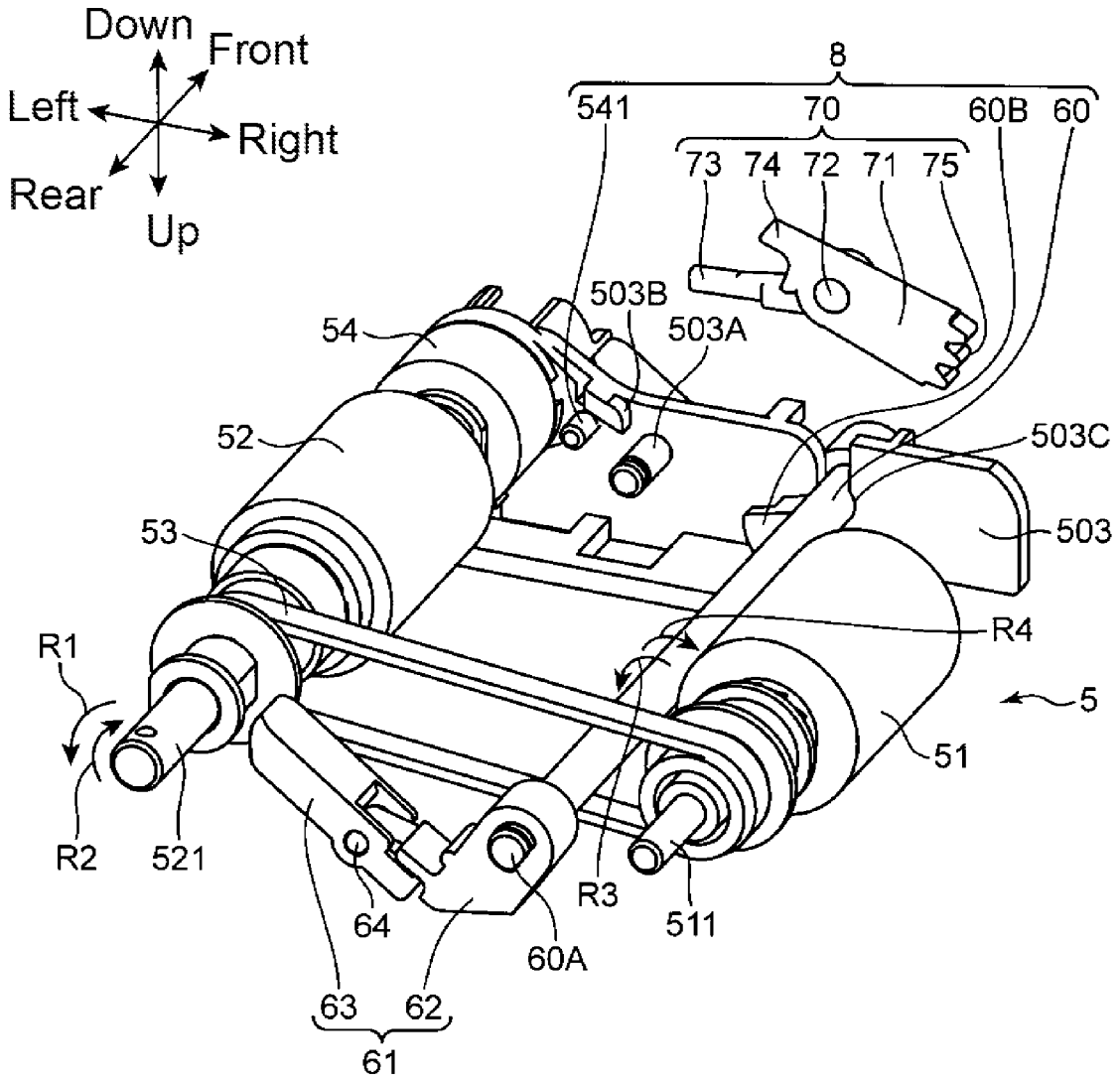
FIG. 8 perspectively illustrates an internal part of the document feeding unit according to the one embodiment.

Next, with reference to FIGS. 5 to 8, the following further describes the document feeding unit 5 according to this embodiment in detail. FIG. 5 illustrates a plan view of the document feeding unit 5 according to the embodiment. FIG. 6A illustrates a cross section of the document feeding unit 5. FIG. 6B illustrates a bottom view of the document feeding unit 5. FIG. 7 perspectively illustrates the document feeding unit 5. Further, FIG. 8 perspectively illustrates a part of the document feeding unit 5. For explanation, FIG. 8 illustrates the internal structure of the document feeding unit 5 by inverting the upper and lower.

The document feeding unit 5 includes the holder 50, the above-described pickup roller 51, and feed roller 52. The document feeding unit 5 includes a pickup roller shaft 511, an input engaging portion 512, and a transmission engaging portion 513. Further, the document feeding unit 5 includes a feed roller shaft 521 (rotation shaft), a unit gear 321 (drive gear), a belt support body 522, a one-way clutch 523, a belt 53, and a torque limiter 54. The automatic document feeding apparatus 3A includes the motor 400 (driving unit).

The holder 50 is a frame part of the document feeding unit 5. The holder 50 supports the pickup roller 51, the feed roller 52, or a similar member. The holder 50 includes a top panel 501, a rear sidewall 502, a front sidewall 503, a first support plate 504, and a second support plate 505. The holder 50 is turnably supported to the upper cover unit 32U using the feed roller shaft 521, which will be described later, as a rotational fulcrum.

The top panel 501 is, as illustrated in FIG. 5, a plate-shaped material having a rectangular shape running in the front-rear and lateral directions. The rear sidewall 502 and the front sidewall 503 are wall portions respectively run from side edges at the front and the rear of the top panel 501 to downward. With reference to FIG. 6B, the first support plate 504 and the second support plate 505 are inner wall portions arranged at a position close to the front sidewall 503 between the rear sidewall 502 and the front sidewall 503. The first support plate 504 and the second support plate 505 disposed upright from the top panel 501 to downward so as to be in parallel to one another while providing a slight space.

The pickup roller shaft 511 serves as a rotation shaft in rotation of the pickup roller 51. The rear sidewall 502 and a second support plate 505T rotatably support the pickup roller shaft 511. The above-described pickup roller 51 is integrally supported by the pickup roller shaft 511 at an immediately rear side of the second support plate 505.

The input engaging portion 512 is an approximately cylindrical-shaped member pivotally supported by the pickup roller shaft 511 at a front side of the rear sidewall 502. With reference to FIG. 5, the input engaging portion 512 includes a belt supporting portion 512A, a first collar portion 512B, and an input piece 512C. The first collar portion 512B is a circular plate member arranged at the axially center of the input engaging portion 512. The input piece 512C and the belt supporting portion 512A are arranged at the front and rear of the first collar portion 512B, respectively. The belt supporting portion 512A has a cylindrical shape and stretches the belt 53, which will be described later. The rotary drive power is transmitted from the belt 53 to the belt supporting portion 512A. The input piece 512C is a projection piece that transmits the rotary drive power to the transmission engaging portion 513. The input piece 512C is formed by axially projecting a part of the first collar portion 512B in a circumferential direction.

The transmission engaging portion 513 is a member formed of an approximately cylindrical shape arranged between the input engaging portion 512 and the pickup roller 51. The transmission engaging portion 513 has a function to transmit the rotary drive power from the input engaging portion 512 to the pickup roller 51. The transmission engaging portion 513 includes a transmission piece 513A, a second collar portion 513B, and a transmission gear unit 513C. The second collar portion 513B is a circular plate member arranged at the axially center of the transmission engaging portion 513. The transmission gear unit 513C and the transmission piece 513A are arranged at the front and rear of the second collar portion 513B, respectively. The transmission piece 513A is formed by axially projecting a part of the second collar portion 513B in the circumferential direction. The input piece 512C of the input engaging portion 512 and the transmission piece 513A are arranged providing a predetermined space in a rotational circumferential direction. In view of this, when the rotary drive power is transmitted from the input piece 512C to the transmission piece 513A, a slight time difference occurs. The transmission gear unit 513C is formed of a plurality of gear teeth (ratchet gear) arranged along the circumferential direction at a side surface of the second collar portion 513B.

Further, the above-described pickup roller 51 includes a roller gear 51A at a side surface on a rear side. The roller gear 51A is formed of a plurality of gear teeth (ratchet gear) circumferentially arranged in the same pitch as the pitch of the transmission gear unit 513C. Meshing the transmission gear unit 513C with the roller gear 51A transmits the rotary drive power from the transmission gear unit 513C to the pickup roller 51.

The feed roller shaft 521 (rotation shaft) pivotally supports the above-described feed roller 52 and serves as the rotation shaft in rotation of the feed roller 52. The upper cover unit 32U rotatably supports the feed roller shaft 521 (see FIG. 17). The feed roller shaft 521 is connected to the motor 400 via the unit gear 321 and an output gear 401, which will be described later. The rear sidewall 502 and the front sidewall 503 of the holder 50 rotatably and pivotally support the feed roller shaft 521. More specifically, a first bearing 521A is fitted to a first cut-out portion 502A formed at a left end portion of the rear sidewall 502. A second bearing 521B is fitted to a bearing mounting portion 503D formed at the left end portion of the front sidewall 503. Then, the first bearing 521A and the second bearing 521B rotatably support the feed roller shaft 521. FIGS. 5 to 16 illustrate the feed roller shaft 521 slightly longer than the holder 50 in the front-rear direction. However, actually, the feed roller shaft 521 runs at the approximately same length as the length of the upper cover unit 32U in the front-rear direction (see FIG. 17).

The unit gear 321 (see FIG. 17) is a gear secured to a rear end portion of the feed roller shaft 521. With the upper cover unit 32U closed, the unit gear 321 is connected to the output gear 401 of the motor 400, which will be described later.

The motor 400 is a motor arranged at the rear wall portion 302 of the main body housing 30. The motor 400 is connected to the feed roller shaft 521. The motor 400 generates the rotary drive power that rotates the feed roller shaft 521. In details, the motor 400 includes the output gear 401 (see FIG. 22). The output gear 401 is a gear arranged at an output shaft of the motor 400. Connecting the output gear 401 to the unit gear 321 transmits the rotary drive power by the motor 400 to the feed roller 52 via the unit gear 321 and the feed roller shaft 521. In this embodiment, the motor 400 can be rotated in a forward direction and in a reverse rotation. The motor 400 rotates the feed roller shaft 521 (feed roller 52) in a first direction (arrow R1 in FIGS. 6B and 7) and a second direction opposite to the first direction (arrow R2 in FIGS. 6B and 7). Rotatably driving the feed roller 52 in the first direction conveys the document sheet P to the downstream side in the sheet conveyance direction (arrow PD in FIGS. 5 and 7).

The motor 400, the feed roller shaft 521, and the unit gear 321 constitute a driving mechanism M. The driving mechanism M has a function to drivingly rotate the pickup roller 51 and the feed roller 52.

The belt support body 522 is a cylindrical member secured to the feed roller shaft 521 at a front side of the first bearing 521A. The belt 53 is stretched at the outer peripheral portion of the belt support body 522.

The belt 53 is, as described above, stretched at predetermined tensile strength between the belt support body 522 and the belt supporting portion 512A of the input engaging portion 512. The belt 53 has a function to transmit the rotary drive power input to the feed roller shaft 521 by the motor 400 to the pickup roller shaft 511 side.

The one-way clutch 523 is pivotally supported to the feed roller shaft 521 at the front side of the belt support body 522. In the forward direction (first direction) of the feed roller 52, the one-way clutch 523 transmits the rotation of the feed roller shaft 521 to the feed roller 52. When the feed roller 52 is rotated in the paper feeding direction by being driven with the document sheet P, the one-way clutch 523 causes the feed roller 52 to idle with respect to the feed roller shaft 521. Consequently, when the drive roller 351A, which is located at the downstream side in the sheet conveyance direction with respect to the feed roller 52, conveys the document sheet P, interference of the conveyance of the document sheet P by the feed roller 52 is reduced.

The torque limiter 54 is pivotally supported to the feed roller shaft 521 between the feed roller 52 and the front sidewall 503. The torque limiter 54 has an approximately cylindrical shape. The torque limiter 54 is rotated integrally with the feed roller shaft 521 in the first direction and the second direction in a first rotating torque. The torque limiter 54 idles with respect to the feed roller shaft 521 in a second rotating torque greater than the first rotating torque. Such relatively low first rotating torque occurs at a start of the rotation of the feed roller 52. The second rotating torque corresponds to a torque during steady rotation of the feed roller 52.

The torque limiter 54 includes an abutting portion 541 (see FIG. 8) (abutting piece). The abutting portion 541 is a projection piece radially projecting from an outer peripheral portion of the torque limiter 54 to the feed roller shaft 521. A distal end portion of the abutting portion 541 cylindrically projects slightly higher in the axial direction of the feed roller shaft 521. The torque limiter 54 and the abutting portion 541 function as an interlocking portion 8, which changes a position of a stopper 63, which will be described later.

Further, the document feeding unit 5 includes a stopper assembly 61 and a lever shaft 60 (supporting shaft). The pair of stopper assemblies 61 are arranged at both the end portions of the holder 50 in the front-rear direction. The pair of stopper assemblies 61 are arranged along the respective rear sidewall 502 and front sidewall 503. The stopper assembly 61 includes a stopper supporting portion 62 and the stopper 63. The stopper supporting portion 62 turnably supports the stopper 63. The lever shaft 60, which will be descried later, supports the stopper supporting portion 62. The stopper 63 is rotatably supported by the distal end portion of the stopper supporting portion 62. In details, with reference to FIG. 8, the stopper 63 is tunable using a turning pivot portion 64 as a fulcrum. The turning pivot portion 64 is formed by inserting a shaft portion formed at the distal end portion of the stopper supporting portion 62 through a hole portion opening to a side surface of the stopper 63. As illustrated in FIG. 7, in turning of the stopper 63, an upper end portion 63A of the stopper 63 can abut on a projection 62A projected from the stopper supporting portion 62. In view of this, a turn angle of the stopper 63 with respect to the stopper supporting portion 62 is regulated within a range where the stopper 63 is turned clockwise in the posture illustrated in FIG. 7. Consequently, even if the document sheet P strikes the stopper 63, the stopper 63 is secured to a projection posture, which will be described later. The above-described pickup roller 51 is rotatably supported by the holder 50 to the lever shaft 60 at the opposite side from the feed roller 52 (see FIGS. 7 and 8).

The stopper 63 can change its posture between the projection posture and an evacuation posture. In the projection posture, the stopper 63 projects to the first conveyance path 341 between the document feed tray 31 and the feed roller 52, namely, upstream with respect to the feed roller 52 in the sheet conveyance direction. In the evacuation posture, the stopper 63 evacuates from the first conveyance path 341. The stopper 63 in the projection posture toward the first conveyance path 341 prevents the document sheet P loaded on the document feed tray 31 from abutting on the feed roller 52. That is, when the user places the plurality of document sheets P on the document feed tray 31, if the document sheets P are strongly pushed into the feed roller 52 side, the document sheet P is sandwiched at the nip portion B1 (see FIG. 4), which is located between the feed roller 52 and the separation pad 350. In this case, the function of the feed roller 52 to feed the document sheets P one by one is interfered. Accordingly, projecting the stopper 63 to the first conveyance path 341 ensures preferably prevents the above-described failure.

The lever shaft 60 runs in the feed roller shaft 521 extending direction and is rotatably supported by the holder 50. More specifically, the lever shaft 60 is rotatably and pivotally supported to a first shaft supporting portion 502B and a second shaft supporting portion 503C. The first shaft supporting portion 502B has an approximately U shape opening to the rear sidewall 502. The second shaft supporting portion 503C similarly has an approximately U shape opening to the front sidewall 503. The lever shaft 60 supports the stopper assembly 61. That is, as illustrated in FIG. 8, a D surface portion 60A formed at one end of the lever shaft 60 is mounted into a hole portion (not illustrated) having a D-shape in a cross-sectional view through the stopper supporting portion 62. Thus, the lever shaft 60 and the stopper assembly 61 are integrated. The above-described constitution is also similarly applied to the arrangement at the other end side of the lever shaft 60 illustrated in FIG. 8. The lever shaft 60 functions as a part of the interlocking portion 8, which will be described later.

Further, the document feeding unit 5 includes the interlocking portion 8. The interlocking portion 8 interlocks with rotation of the feed roller 52 to cause stopper 63 to change between the projection posture with respect to the first conveyance path 341 and the evacuation posture, thus fixing the stopper 63 to the respective postures. More specifically, the interlocking portion 8 causes the stopper 63 to fix at the projection posture corresponding to the rotation of the feed roller 52 in the second direction and causes the stopper 63 to fix at the evacuation posture corresponding to the rotation in the first direction. The interlocking portion 8 includes a lever 70 (connecting member) and a first gear unit 60B (engaged gear) in addition to the above-described torque limiter 54 and lever shaft 60.

The lever 70 is turnably arranged at an inside of the front sidewall 503. The lever 70 is abutted on the abutting portion 541 corresponding to the rotation of the feed roller shaft 521 in the first direction (arrow R1 in FIG. 8) and the second direction (arrow R2 in FIG. 8). Thus, the lever 70 causes the lever shaft 60 to rotate in a third direction (arrow R3 in FIG. 8) and a fourth direction (arrow R4 in FIG. 8), which is opposite to the third direction. The lever 70 includes a lever main body 71, a fulcrum portion 72, a first projection 73, a second projection 74, and a second gear unit 75 (engaging gear).

The lever main body 71 is a main part of the lever 70. The lever main body 71 is an elongated member extending in an approximately lateral direction. The fulcrum portion 72 is an opening that opens in the front-rear direction at the approximately center of the lever main body 71 in the longitudinal direction. The fulcrum portion 72 is inserted through a lever shaft 503A projecting from the front sidewall 503 to rearward. Consequently, the lever 70 becomes tunable using the fulcrum portion 72 as a fulcrum.

The first projection 73 is a projection projected from the fulcrum portion 72 toward the torque limiter 54. The second projection 74 runs from the fulcrum portion 72 toward the torque limiter 54 at the downstream with respect to the first projection 73 in the first direction. The second projection 74 is forked into two branches between the fulcrum portion 72 and the first projection 73. That is, the first projection 73 and the second projection 74 run in different directions from the fulcrum portion 72. The first projection 73 and the second projection 74 abut on the abutting portion 541 in association with the rotation by the torque limiter 54. The second gear unit 75 is arranged at the opposite side from the first projection 73 and the second projection 74 with respect to the fulcrum portion 72, and the second gear unit 75 is installed opposed to the lever shaft 60. The second gear unit 75 has a plurality of gear teeth adjacently arranged in an arc-like manner at the end portion of the lever main body 71.

The first gear unit 60B is arranged at the outer peripheral portion of the lever shaft 60. The first gear unit 60B is arranged opposed to the second gear unit 75 of the lever 70. The first gear unit 60B is, similarly to the second gear unit 75, has a plurality of gear teeth adjacently arranged in an arc-like manner. Inserting the fulcrum portion 72 of the lever 70 through the lever shaft 503A of the front sidewall 503 meshes the first gear unit 60B and the second gear unit 75. Consequently, the lever shaft 60 becomes rotatable in association with the turning of the lever 70 around the fulcrum portion 72.

Figure 9:
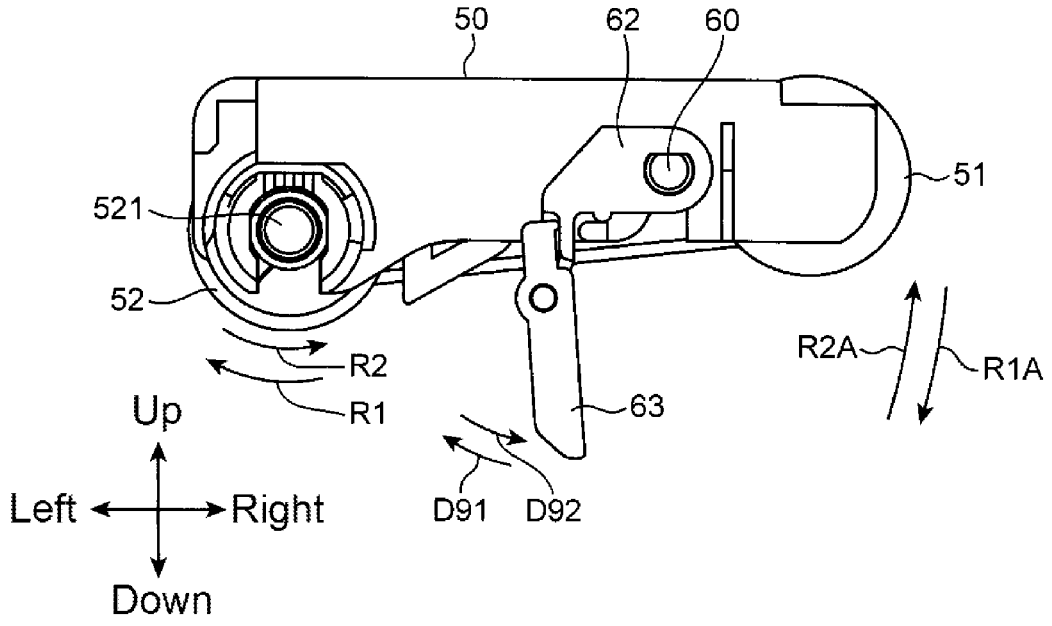
FIG. 9 illustrates a side of the document feeding unit according to the one embodiment.
Figure 10:
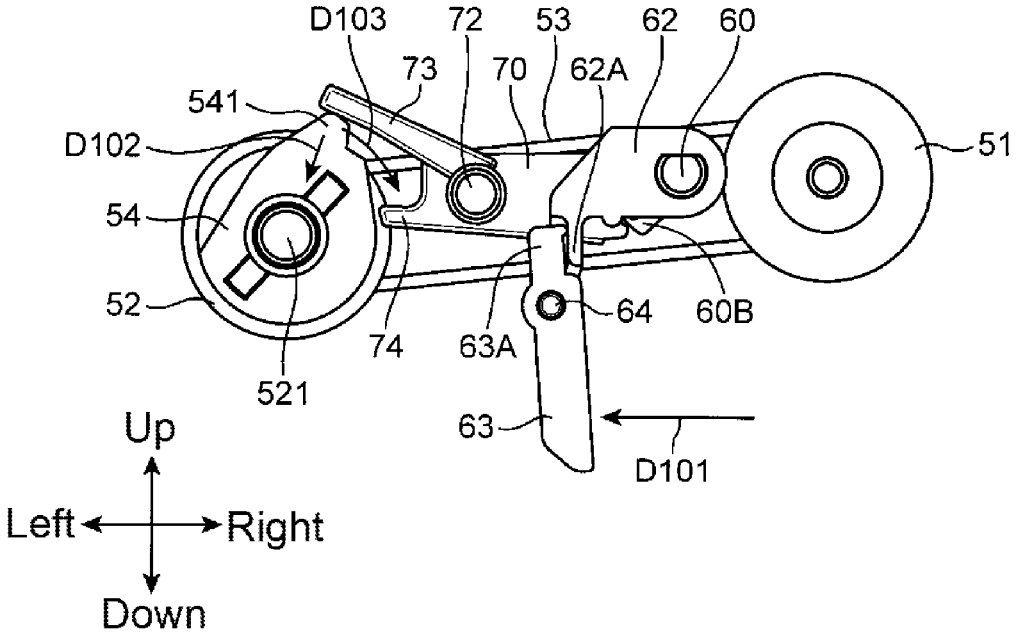
FIG. 10 illustrates a side of an inside of the document feeding unit according to the one embodiment.
Figure 11:
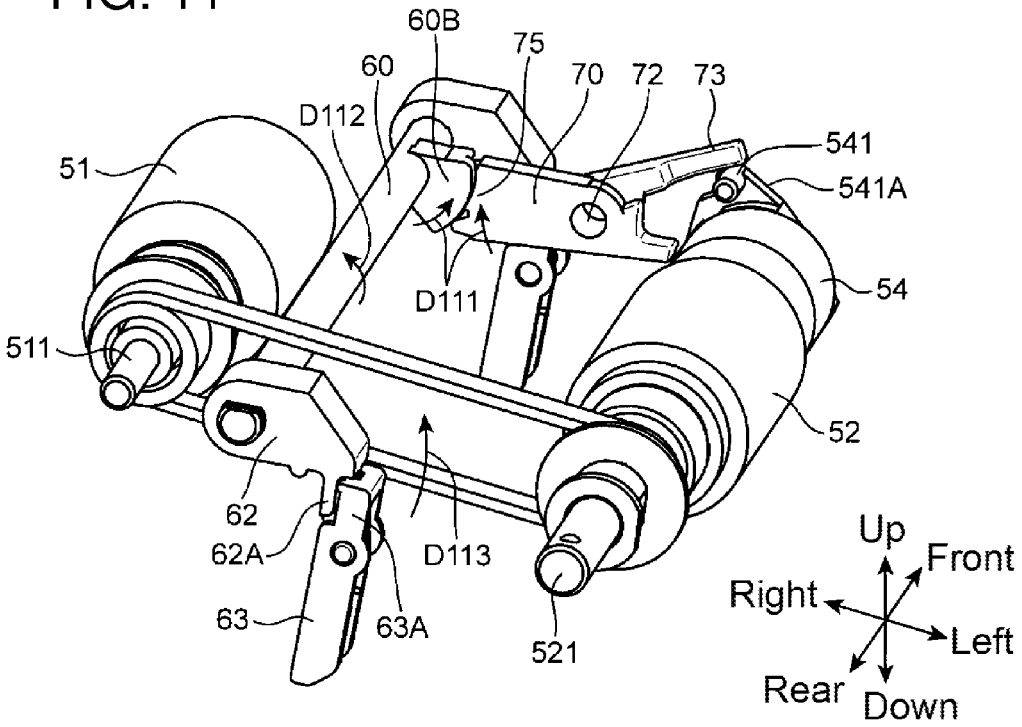
FIG. 11 perspectively illustrates the inside of the document feeding unit according to the one embodiment.
Figure 12:
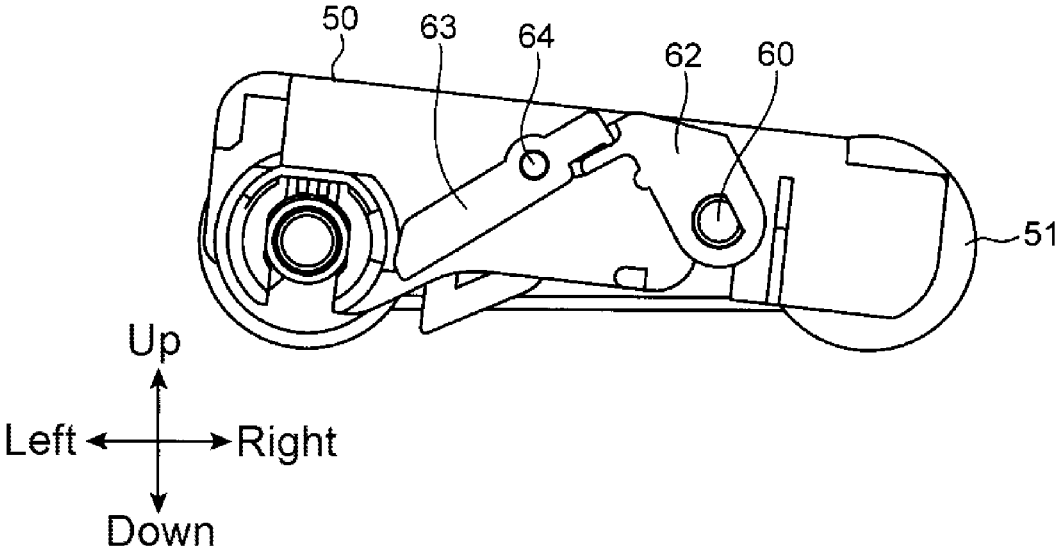
FIG. 12 illustrates a side of the document feeding unit according to the one embodiment.
Figure 13:
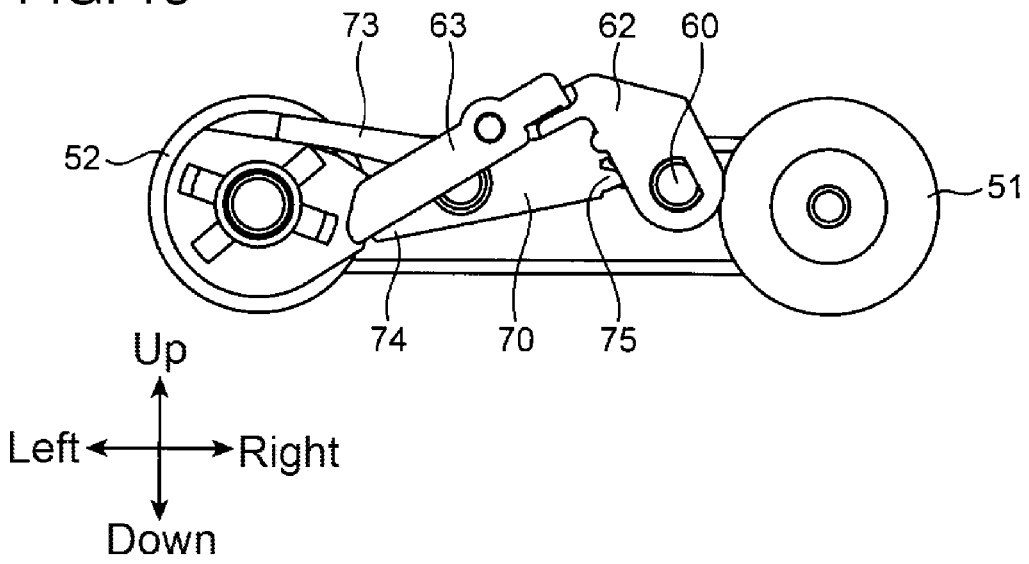
FIG. 13 illustrates a side of an inside of the document feeding unit according to the one embodiment.
Figure 14:
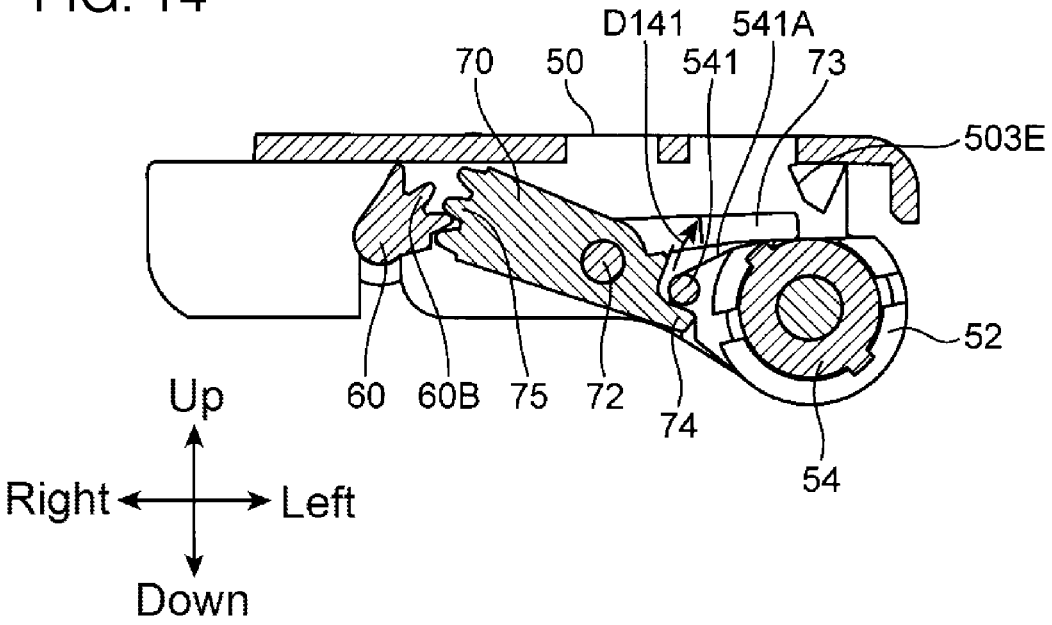
FIG. 14 illustrates a cross section of the inside of the document feeding unit according to the one embodiment.
Figure 15:
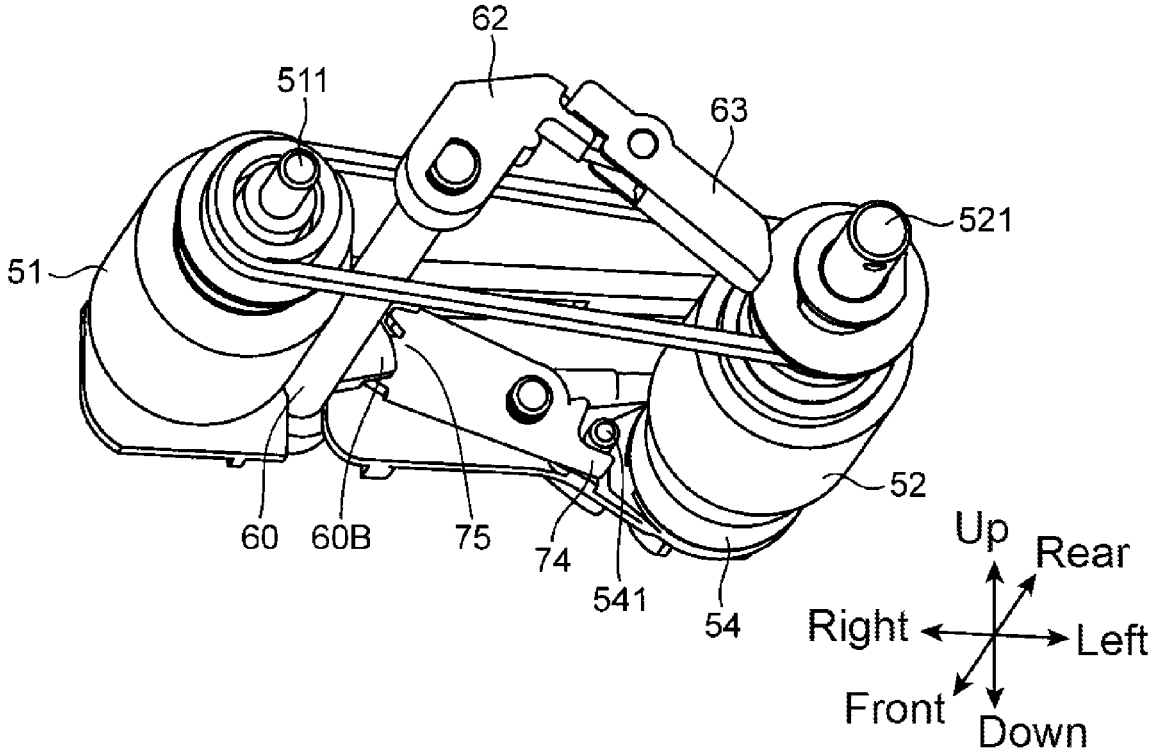
FIG. 15 perspectively illustrates the inside of the document feeding unit according to the one embodiment.
Figure 16:
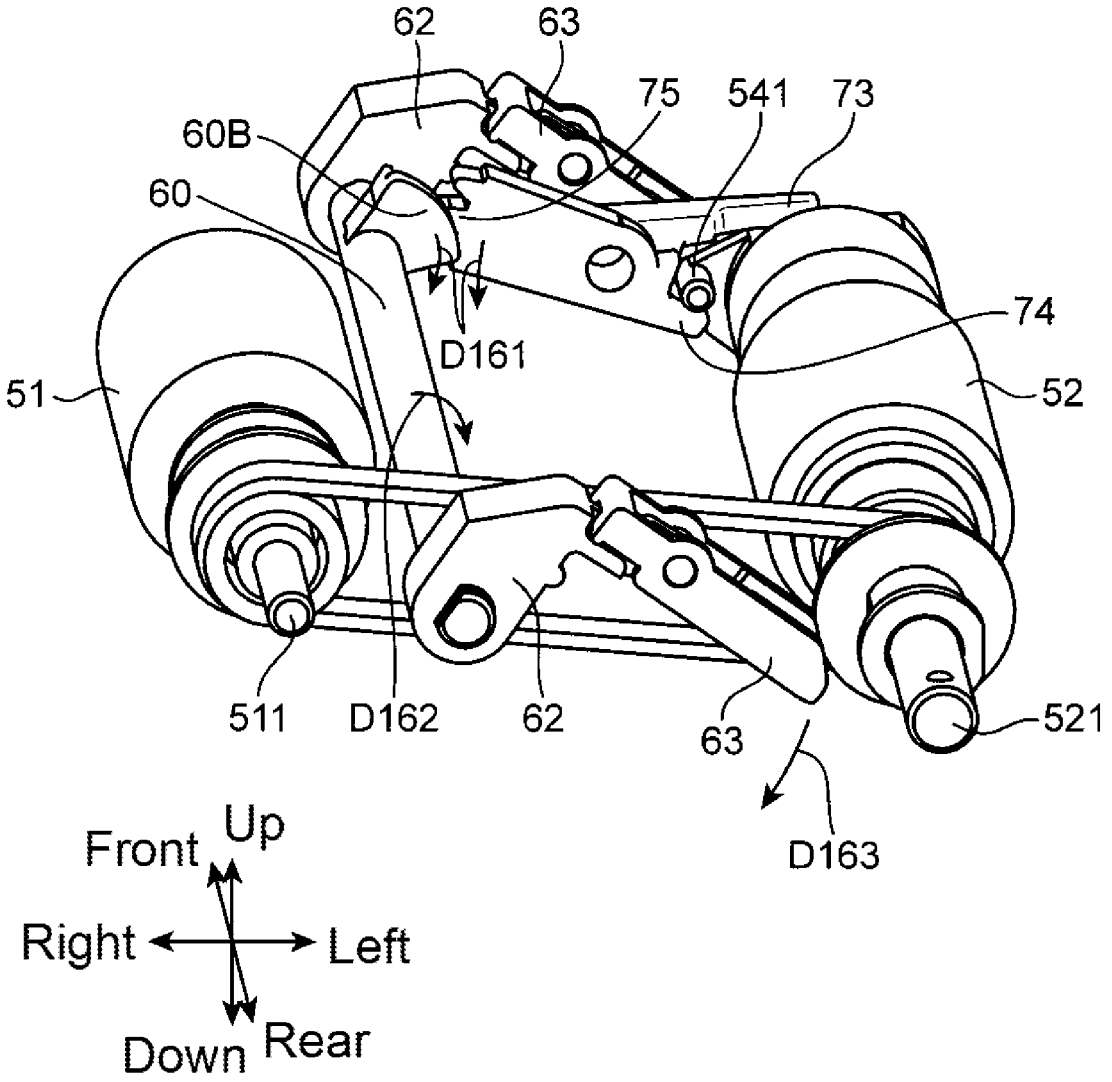
FIG. 16 perspectively illustrates the inside of the document feeding unit according to the one embodiment.

Next, with reference to FIGS. 9 to 16, the following describes a function to regulate the stopper 63 and an appearance operation of the stopper 63 in detail. FIG. 9 illustrates a side of the document feeding unit 5 according to the embodiment. FIG. 10 illustrates a side of the inside of the document feeding unit 5 of FIG. 9. Further, FIG. 11 perspectively illustrates the inside of the document feeding unit 5 of FIG. 9. FIG. 12 illustrates a side of the document feeding unit 5. FIG. 13 illustrates a side of the inside of the document feeding unit 5 of FIG. 12. Similarly, FIG. 14 illustrates a cross section of the inside of the document feeding unit 5 of FIG. 12. FIGS. 15 and 16 perspectively illustrate the inside of the document feeding unit 5 of FIG. 12. FIGS. 9 to 11 illustrate a state where the feed roller 52 is reversely rotated (rotated in the second direction) and the stopper 63 projects to the first conveyance path 341 (projection posture). FIGS. 12 to 16 illustrate a state where the feed roller 52 rotates in the forward direction (rotated in the first direction) and the stopper 63 is evacuated (evacuation posture) from the first conveyance path 341.

Function of Regulate Stopper 63

As illustrated in FIGS. 9 to 11, when a paper feeding operation is not performed by the feed roller 52, reversely rotating the feed roller 52 sets the stopper 63 to the projection posture projecting to the first conveyance path 341. Consequently, as illustrated in an arrow D101 in FIG. 10, even if the document sheet P is strongly pushed toward the feed roller 52, the document sheet P is prevented from being abutted on the feed roller 52. Additionally remarking the arrangement at the periphery of the lever 70 in this state, the abutting portion 541 of the torque limiter 54 postures projecting upward and abuts on the lower surface of the first projection 73 of the lever 70. Then, the first projection 73 and the second projection 74 sides of the lever 70 are arranged so as to face upward with respect to the fulcrum portion 72 while the second gear unit 75 side of the lever 70 is arranged so as to face slightly downward. Consequently, as illustrated in FIG. 11, the first gear unit 60B meshing the second gear unit 75 is also arranged facing slightly downward. In other words, among the respective gears arrayed in the arc-like manner at the first gear unit 60B and the second gear unit 75, the gear parts at the upper end portions abut on one another. Among the stopper assemblies 61 secured to both the end portions of the lever shaft 60, the stopper 63 runs downward.

Here, as described above, the upper end portion 63A of the stopper 63 is arranged opposed to the projection 62A projecting from the stopper supporting portion 62. Accordingly, when the document sheet P is pushed in the direction of the arrow D101 in FIG. 10, the upper end portion 63A abuts on the projection 62A. This prevents the stopper 63 from turning clockwise centering the turning pivot portion 64, thus the stopper 63 is kept fixed at the projection posture. That is, the document sheet P is restricted to enter the feed roller 52. When the document sheet P is pushed in the direction of the arrow D101 in FIG. 10, pressing force transmitted to the stopper 63 and the stopper supporting portion 62 gives rotatory power to the first gear unit 60B of the lever shaft 60 and the second gear unit 75 in the direction of an arrow D111 in FIG. 11. In this case, the lever 70 rotates around the fulcrum portion 72, possibly causing incorrect rotation of the torque limiter 54. However, in this embodiment, as illustrated in an arrow D102 in FIG. 10, the pressing force to the abutting portion 541 of the first projection 73 is given to a shaft center or a neighborhood of the shaft center of the feed roller shaft 521. Accordingly, circumferential force that rotates the torque limiter 54 is less likely to be given to the abutting portion 541. Consequently, even if the document sheet P is strongly pushed to the stopper 63, incorrect rotations of the torque limiter 54 and the feed roller 52 can be reduced. Even if the user adds vibrations to the automatic document feeding apparatus 3A when aligning one end of a bundle of documents at the top surface of the automatic document feeding apparatus 3A, since the first projection 73 and the abutting portion 541 are pushed to one another, rotations of the torque limiter 54 and the feed roller shaft 521, which supports the torque limiter 54, are preferably reduced.

Appearance Operation of Stopper 63

In the states of FIGS. 9 to 11, when the automatic document feeding apparatus 3A starts the paper feeding operation, the above-described motor 400 rotates the feed roller shaft 521 in the forward direction (first direction) (arrow R1 in FIGS. 6B, 8, and 9). As described above, the torque limiter 54 integrally rotates with the feed roller shaft 521 during a low torque at the start of the feed roller 52. Consequently, the abutting portion 541 is rotated in the direction indicated by the arrow 103 illustrated in FIG. 10. In association with the rotation, the abutting portion 541 is disengaged from the first projection 73, and then the abutting portion 541 abuts on the second projection 74 arranged downstream of the first projection 73 in the first direction. Consequently, the lever 70 is turned around the fulcrum portion 72, and the second gear unit 75 side of the lever 70 moves upward. Then, the first gear unit 60B meshing the second gear unit 75 is also similarly moved upward (arrow D111 in FIG. 11). This rotates the lever shaft 60 in the third direction so as to pull up the stopper 63 (arrow D91 in FIG. 9, arrows D112 and D113 in FIG. 11). Consequently, as illustrated in FIGS. 12 to 16, the abutting portion 541, the lever 70, and the lever shaft 60 are arranged, and the stopper 63 becomes to have the evacuation posture evacuated from the first conveyance path 341. FIGS. 12 to 16 illustrate the state of the stopper 63 evacuated from the first conveyance path 341 being approximately perpendicular to the stopper supporting portion 62. When the stopper 63 evacuates from the first conveyance path 341, the stopper 63 may also turn by its own weight using the turning pivot portion 64 as the fulcrum and may hang down verticality downward. Even in this case, since the lower end portion of the stopper 63 is arranged above a straight line connecting the lowest end portions of the circumference surfaces of the pickup roller 51 and the feed roller 52, conveyance of the document sheets P is not restricted. As described later, during the paper feeding operation by the feed roller 52, since the holder 50 turns such that the pickup roller 51 moves downward, similarly, the lower end portion of the stopper 63 does not contact the document sheet P. Accordingly, in all the above-described aspects, the stopper 63 is in a state of being fixed at the evacuation posture.

In the state illustrated in FIGS. 12 to 16, to make additional remark on the arrangement at the periphery of the lever 70, the abutting portion 541 of the torque limiter 54 has a posture projected toward an approximately right side, thus abutting on the top surface of the second projection 74 of the lever 70 (see FIG. 14). In this respect, the abutting portion 541 is arranged so as to be sandwiched between the first projection 73 and the second projection 74. Then, the first projection 73 and the second projection 74 sides of the lever 70 are arranged so as to be inclined downward with respect to the fulcrum portion 72 while the second gear unit 75 side of the lever 70 is arranged so as to face slightly upward. Consequently, the first gear unit 60B meshing the second gear unit 75 is also arranged toward slightly upward. In other words, in the first gear unit 60B and the second gear unit 75, among the respective gears arrayed in the arc-like manner, the gear parts at the lower end portions abut on one another. Then, among the stopper assemblies 61 secured to both the end portions of the lever shaft 60, the stopper supporting portion 62 runs upward and leftward, and the stopper 63 runs leftward and downward. As described above, the stopper 63 may extend verticality downward.

In the state illustrated in FIGS. 12 to 16, rotations of the feed roller 52 and the pickup roller 51 send the document sheets P placed on the document feed tray 31 to the first conveyance path 341. After the paper feeding operation is terminated, a control unit (not illustrated) reversely rotates the motor 400. This rotates the feed roller shaft 521 in the reverse direction (second direction) (arrow R2 in FIGS. 6B, 8, and 9). Similarly to the forward direction, the torque limiter 54 integrally rotates with the feed roller shaft 521 during the low torque at the start of the feed roller 52. Consequently, the abutting portion 541 is rotated in the direction indicated by an arrow D141 illustrated in FIG. 14. In association with the rotation, the abutting portion 541 is disengaged from the second projection 74 and abuts on the first projection 73 again. Consequently, the lever 70 is turned around the fulcrum portion 72, and the second gear unit 75 side of the lever 70 moves downward. Then, the first gear unit 60B meshing the second gear unit 75 is also similarly moved downward (arrow D161 in FIG. 16). This rotates the lever shaft 60 in the fourth direction so as to push the stopper 63 downward (arrow D92 in FIG. 9, arrows D162 and D163 in FIG. 16). Consequently, the abutting portion 541, the lever 70, and the lever shaft 60 are arranged as illustrated in FIGS. 9 to 11 again, and the stopper 63 takes the projection posture projecting to the first conveyance path 341. Thus, in this embodiment, in conjunction with the rotation operation of the feed roller 52, the appearance operation of the stopper 63 to the first conveyance path 341 is achieved.

In view of this, a dedicated driving unit is not required for the stopper 63 to appear and disappear (appearance operation), ensuring reliably achieving the change of and the maintenance of the posture of the stopper 63 according to the rotation of the feed roller 52. During the paper feeding operation by the feed roller 52, the stopper 63 does not prevent the conveyance of the document sheet P. While the feed roller 52 does not convey the document sheet P in the sheet conveyance direction, the stopper 63 can preferably regulate the position of the document sheet P. Further, using the torque limiter 54, the abutting portion 541 can be moved by a torque during the start of the feed roller 52 being rotated in the first and second directions. When the abutting portion 541 abuts on the lever 70, the lever shaft 60 is rotated, thus the appearance operation of the stopper 63 is preferably achieved.

Turning Operation of Holder 50

Further, in this embodiment, in conjunction with the rotation operation of the feed roller 52, the holder 50 is turned. This achieves vertical movement of the pickup roller 51. The holder 50 includes the first protrusion 503B illustrated in FIGS. 6B and 7. The holder 50 includes a second protrusion 503E illustrated in FIGS. 6A and 14.

A first protrusion 503B is a projection projected from the inner wall of the front sidewall 503. The first protrusion 503B projects so as to enter in a rotational orbit of the abutting portion 541. With reference to FIG. 14, in association with the forward direction (rotation in the first direction) of the feed roller 52, the abutting portion 541 pushes the second projection 74 downward and then abuts on the first protrusion 503B (see FIG. 7). As described above, the abutting portion 541 is arranged having a large width in the axis direction of the feed roller shaft 521. In view of this, with the state where one end side of the abutting portion 541 in the axial direction abuts on the second projection 74, the other end side of the abutting portion 541 abuts on the first protrusion 503B. The abutting portion 541 abutting on the first protrusion 503B pushes the holder 50 downward by the rotatory power transmitted to the feed roller shaft 521. Consequently, using the feed roller shaft 521 as the fulcrum, the holder 50 on the pickup roller 51 side is pushed downward. That is, the holder 50 is turned around the feed roller shaft 521 in the first direction (see arrow R1A in FIG. 9). The pickup roller 51 abutting on the document sheet P placed on the document feed tray 31 stops the turning of the holder 50.

Similarly, the second protrusion 503E is a projection projected from the inner wall of the front sidewall 503. The second protrusion 503E provides a space from the first protrusion 503B in the circumferential direction. The second protrusion 503E projects so as to enter in the rotational orbit of the abutting portion 541. With reference to FIG. 14, in association with the reverse rotation (rotation in the second direction) of the feed roller 52, the abutting portion 541 abuts on the lower surface of the first projection 73 and then abuts on the second protrusion 503E. In this respect, as illustrated in FIG. 6A and FIG. 11, with the state where the distal end portion of the abutting portion 541 abuts on the first projection 73, a base end portion of the abutting portion 541 abuts on the second protrusion 503E. The abutting portion 541 abutting on the second protrusion 503E pushes the holder 50 upward by the rotatory power transmitted to the feed roller shaft 521. As a result, using the feed roller shaft 521 as the fulcrum, the pickup roller 51 side of the holder 50 is pushed upward. That is, the holder 50 is turned around the feed roller shaft 521 in the second direction (see arrow R2A in FIG. 9). Consequently, the pickup roller 51 is upwardly separated from the document sheet P on the document feed tray 31. The top panel 501 of the holder 50 abutting on the upper cover unit 32U (see FIG. 4) stops the turning of the holder 50. Thus, in this embodiment, in conjunction with the rotation operation of the feed roller 52, the holder 50 is turned. This achieves the vertical movement of the pickup roller 51. In particular, in association with the movement of the abutting portion 541, the change of the stopper 63 to the evacuation posture and the movement of the pickup roller 51 to the paper feeding position are preferably achieved. Additionally, in association with the movement of the abutting portion 541, the change of the stopper 63 to the projection posture and the movement of the pickup roller 51 to a non-paper feeding position are preferably achieved.

Operation of Stopper in Association with Opening and Close of Cover Member

Figure 17:
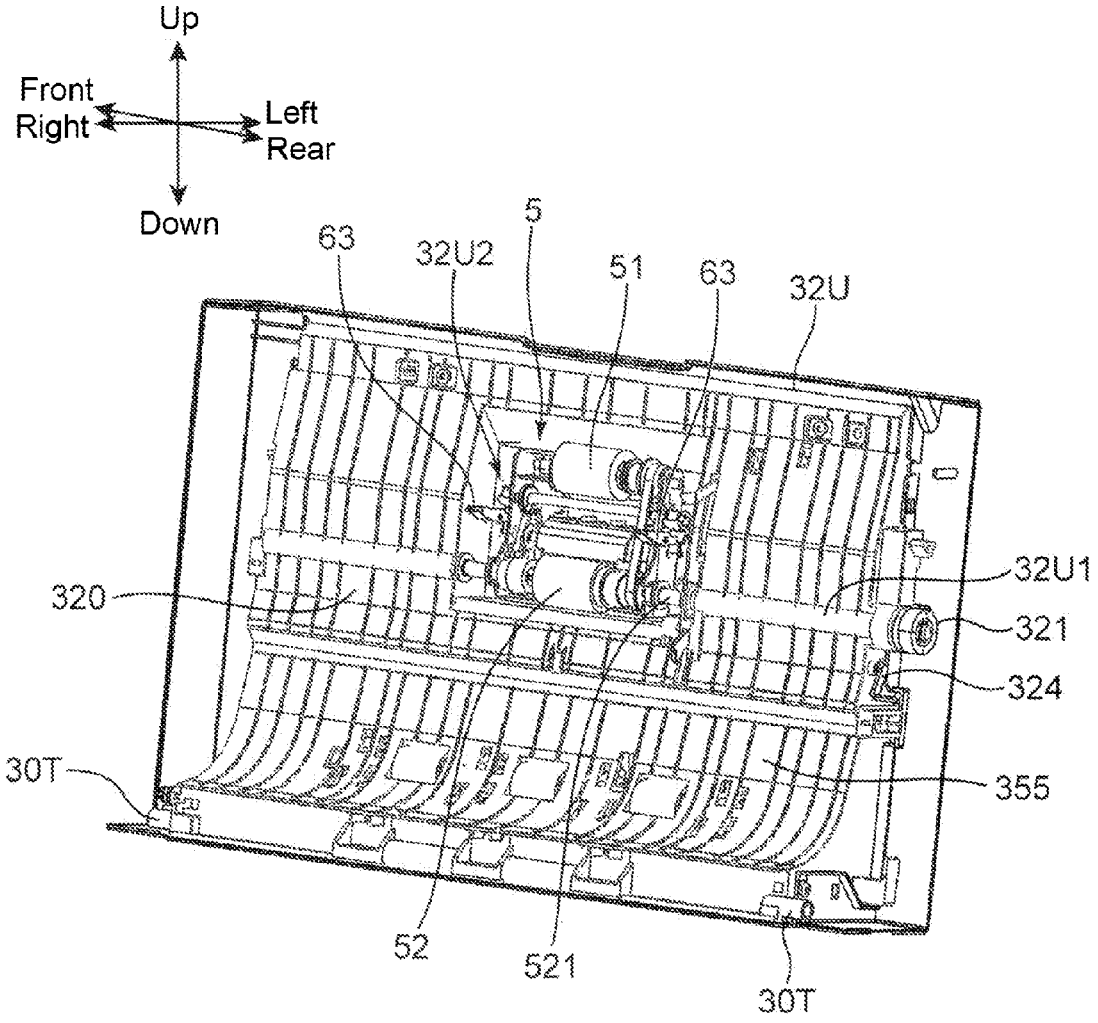
FIG. 17 perspectively illustrates a cover member according to the one embodiment.
Figure 18:
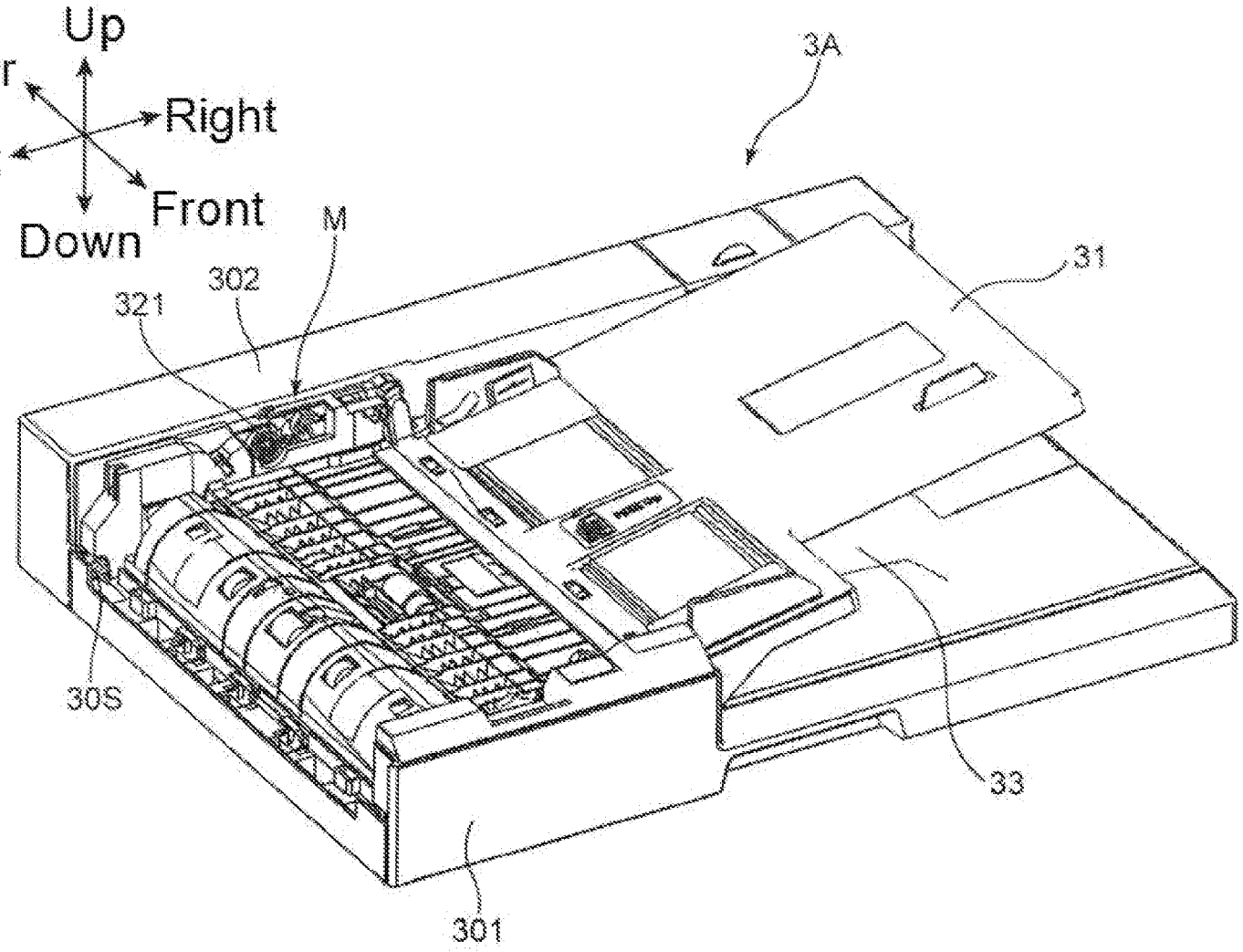
FIG. 18 perspectively illustrates an inside of the automatic document feeding apparatus according to the one embodiment.
Figure 19:
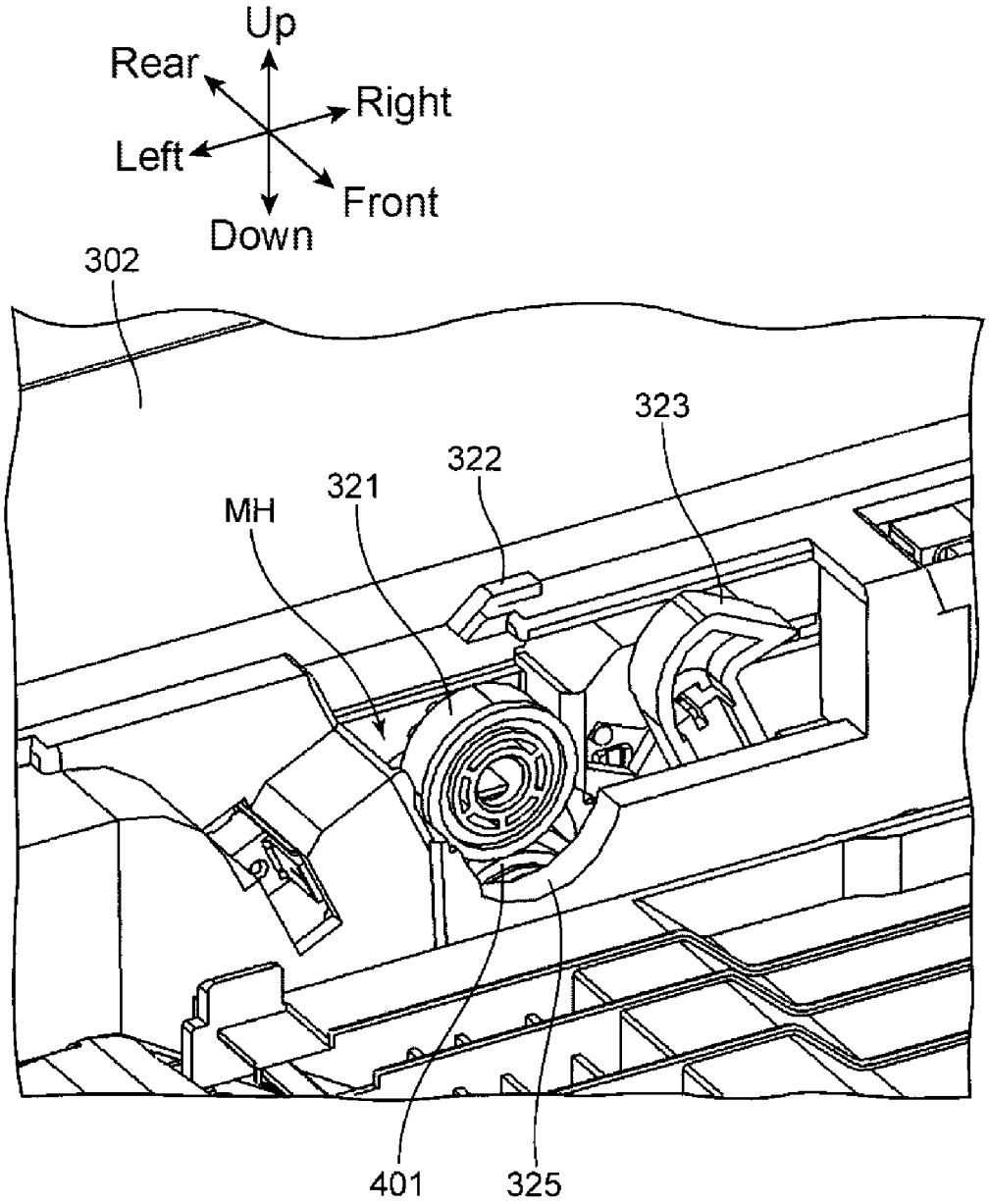
FIG. 19 perspectively illustrates a partially enlarged automatic document feeding apparatus according to the one embodiment.
Figure 20:
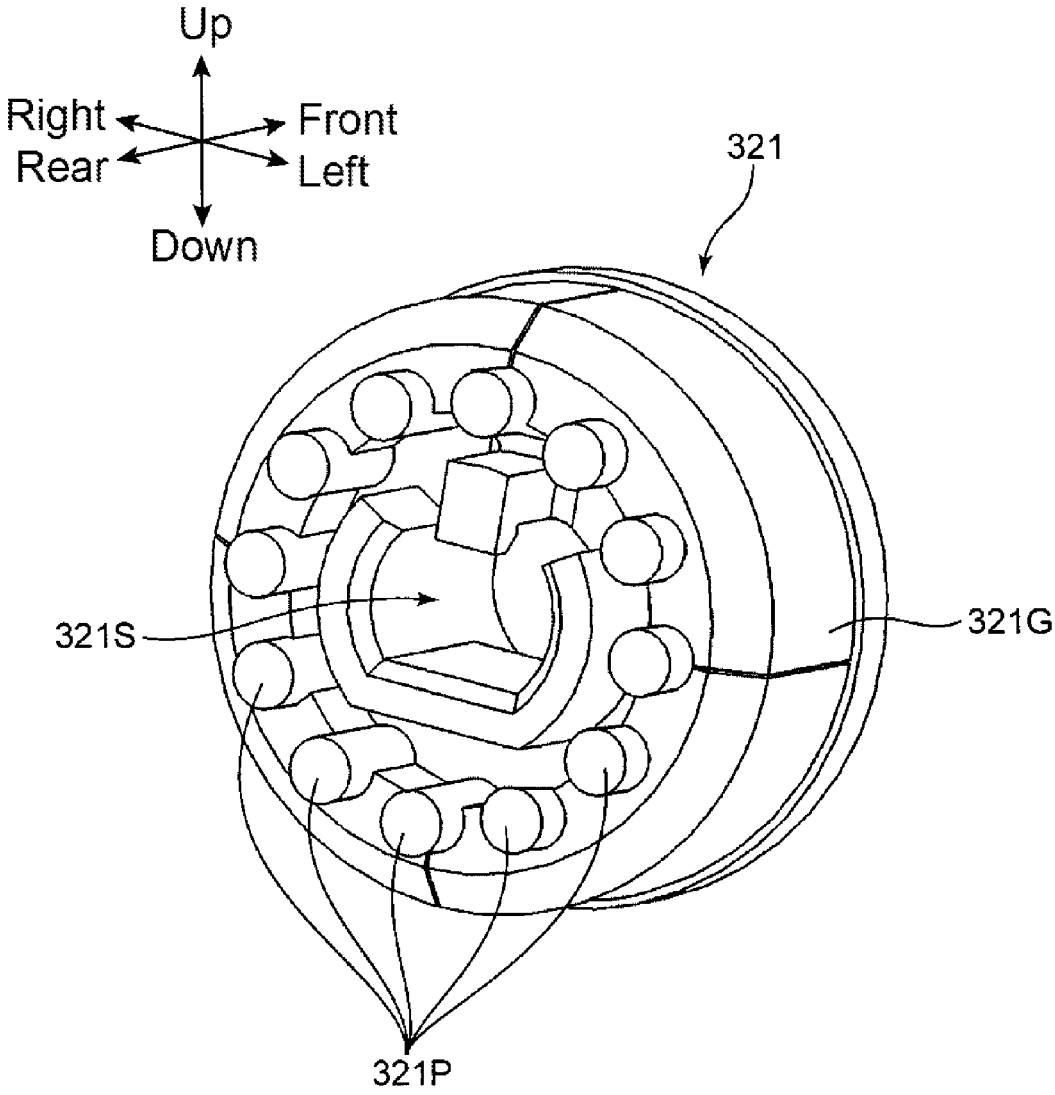
FIG. 20 perspectively illustrates a drive gear according to the one embodiment.

Next, with reference to FIGS. 17 to 20, the following describes a structure at the periphery of the upper cover unit 32U according to the embodiment and open/close operations of the upper cover unit 32U. FIG. 17 perspectively illustrates the open upper cover unit 32U according to the embodiment. FIG. 18 perspectively illustrates an inside of the automatic document feeding apparatus according to the embodiment. FIG. 19 perspectively illustrates a part of the automatic document feeding apparatus 3A of FIG. 18. FIG. 20 perspectively illustrates the unit gear 321 according to the embodiment.

With reference to FIG. 17, the above-described document feeding unit 5 is arranged at a guide surface 320 side of the upper cover unit 32U. In particular, a unit housing portion 32U2 houses the document feeding unit 5. The unit housing portion 32U2 is formed at a space where the guide surface 320 is partially depressed into a rectangular shape. As described above, the feed roller shaft 521 runs from the document feeding unit 5 back and forth. The feed roller shaft 521 is arranged inside of a shaft cover 32U1. The shaft cover 32U1 is formed by partially projecting the guide surface 320 in a cylindrical shape. Then, the end portion on a rear side of the feed roller shaft 521 is exposed to a rear side surface of the upper cover unit 32U. The unit gear 321 is secured to the end portion.

The upper cover unit 32U includes a pair of rotation shaft portions 30T (see FIG. 17). The rotation shaft portions 30T are a pair of shaft portions arranged at a left end portion and a lower end portion when the upper cover unit 32U is closed to the main body housing 30. The rotation shaft portions 30T are inserted into a pair of bearing portions 30S (cover fulcrum portions) (see FIG. 18) open to the main body housing 30. In FIG. 18, the bearing portion 30S at the front side does not appear. By turning the upper cover unit 32U using the bearing portion 30S arranged at the main body housing 30 as the fulcrum, the upper cover unit 32U is openable/closable to the main body housing 30. Then, as described above, when the upper cover unit 32U is opened, the first conveyance path 341 and the second conveyance path 342 (see FIG. 4) are open to the outside of the main body housing 30.

With reference to FIG. 18, a driving mechanism M is arranged at the rear wall portion 302. The driving mechanism M generates the rotary drive power, which is to be transmitted to the document feeding unit 5. In details, as illustrated in FIG. 19, the driving mechanism M is arranged at a drive housing portion MH. The drive housing portion MH is formed at a space where the rear wall portion 302 is partially depressed. For explanation, FIGS. 18 and 19 illustrate the unit gear 321, which is arranged on the upper cover unit 32U side, together with the rear wall portion 302. In the driving mechanism M, the motor 400 (see FIG. 5) is arranged at a lower part of the drive housing portion MH (see FIG. 19). In FIG. 19, the output gear 401 of the motor 400 appears. When the upper cover unit 32U is closed to the main body housing 30, as illustrated in FIG. 19, the unit gear 321 is connected to the output gear 401. Consequently, the rotary drive power generated by the motor 400 is transmitted to the feed roller 52 via the output gear 401, the unit gear 321, and the feed roller shaft 521. An arc portion 325 is formed at the drive housing portion MH of the rear wall portion 302, being opposed to the feed roller shaft 521 (see FIG. 17).

The rear wall portion 302 of the automatic document feeding apparatus 3A includes a hook 323 (see FIG. 19). Meanwhile, the upper cover unit 32U includes a lock portion 324 (see FIG. 17). When the upper cover unit 32U is closed to the main body housing 30, the lock portion 324 is locked to the hook 323, thus securing the upper cover unit 32U. When the upper cover unit 32U is opened, clasping a lever portion (not illustrated) disengages the lock portion 324 from the hook 323, thus ensuring turning of the upper cover unit 32U.

With reference to FIG. 20, the unit gear 321 includes a shaft mounting portion 321S, an outer periphery gear unit 321G (outer peripheral portion), and an engaging pin 321P. The shaft mounting portion 321S is a shaft hole to which the end portion of the feed roller shaft 521 is to be mounted. For integral rotation of the unit gear 321 and the feed roller shaft 521, the shaft mounting portion 321S has a D-shaped inner peripheral portion. The outer periphery gear unit 321G includes gear teeth to be engaged with the output gear 401. FIG. 20 omits illustration of the gear teeth. The engaging pin 321P is a pin that projects from one side surface intersecting with the outer periphery gear unit 321G in the unit gear 321, in the axial direction of the rotation of the unit gear 321. An engagement projection 322, which will be described later, abuts on the engaging pin 321P. The plurality of engaging pins 321P are arranged along the circumferential direction of the rotation of the unit gear 321.

Figure 21:
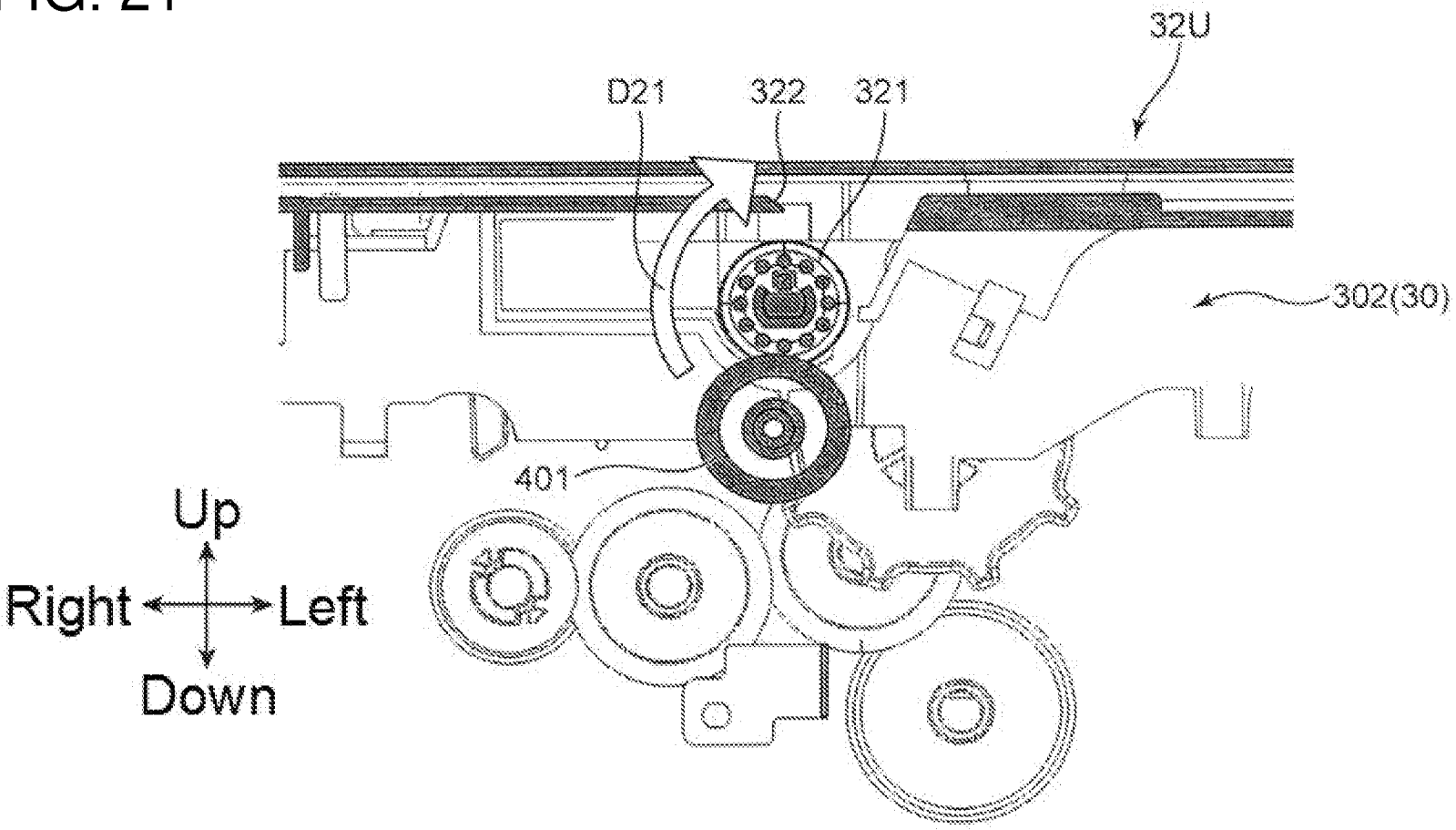
FIG. 21 illustrates a cross section of a motion of the drive gear according to the one embodiment.
Figure 22:
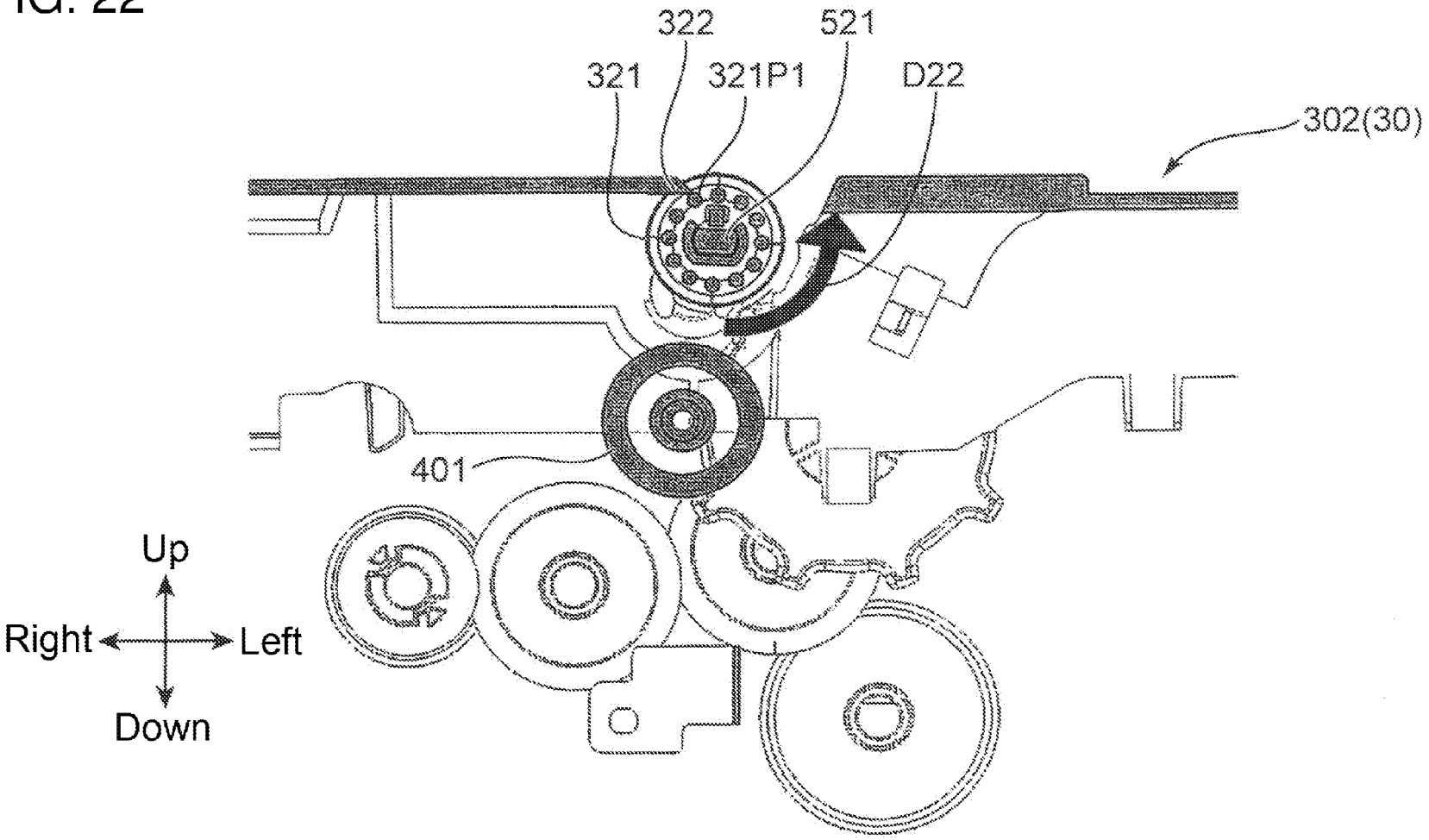
FIG. 22 illustrates a cross section of a motion of the drive gear according to the one embodiment.
Figure 23:
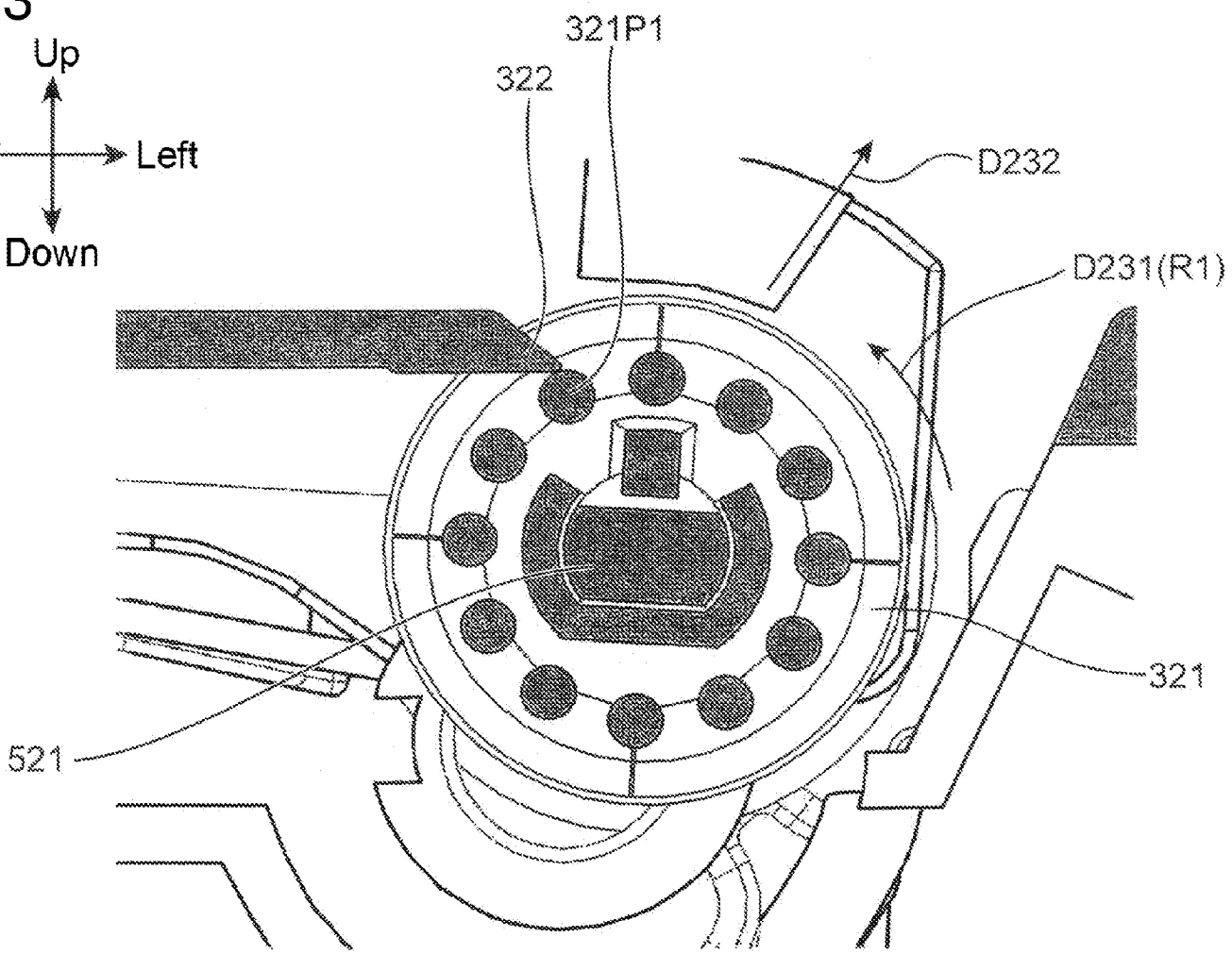
FIG. 23 illustrates an enlarged cross section of a motion of the drive gear according to the one embodiment.
Figure 24:
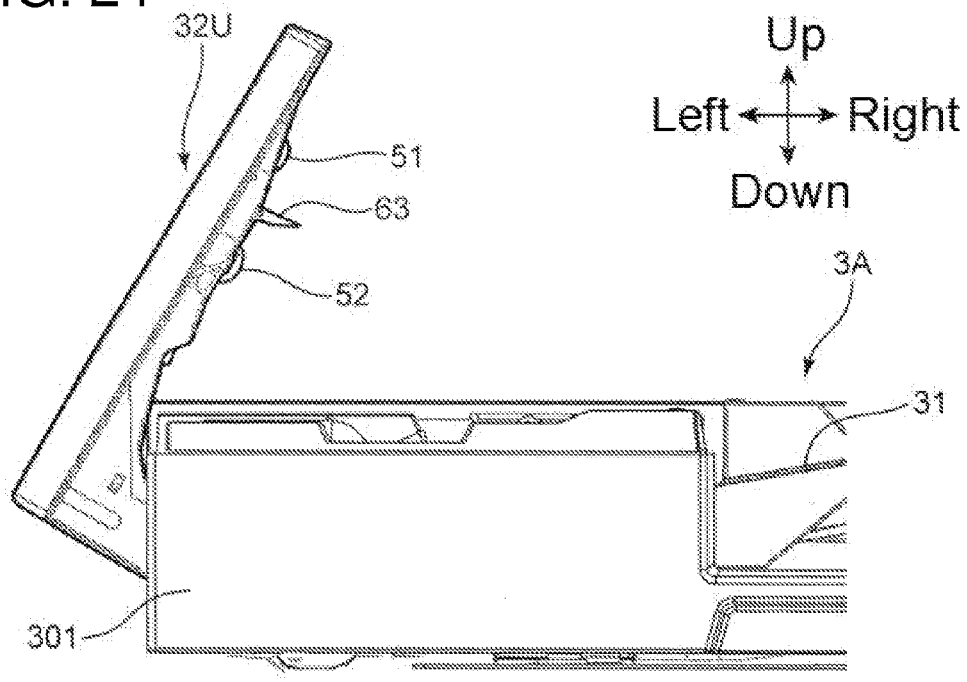
FIG. 24 illustrates an enlarged front view where the cover member is open and a stopper projects in the automatic document feeding apparatus according to the one embodiment.
Figure 25:
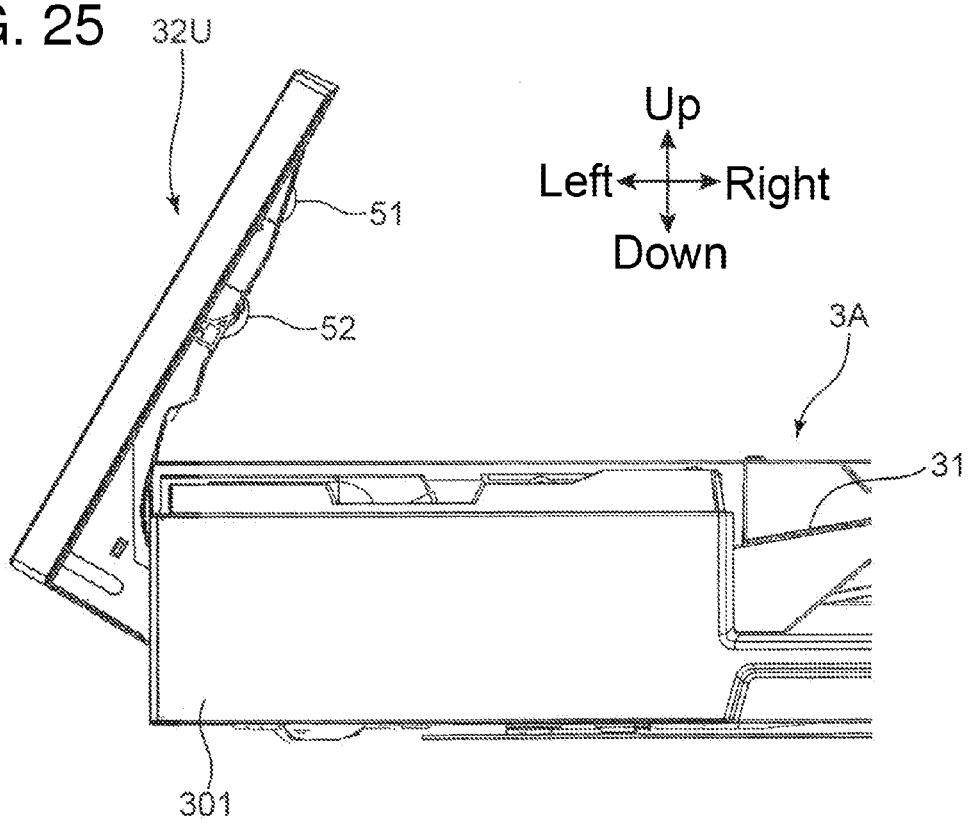
FIG. 25 illustrates an enlarged front view where the cover member is open and the stopper evacuates in the automatic document feeding apparatus according to the one embodiment.
Figure 26:
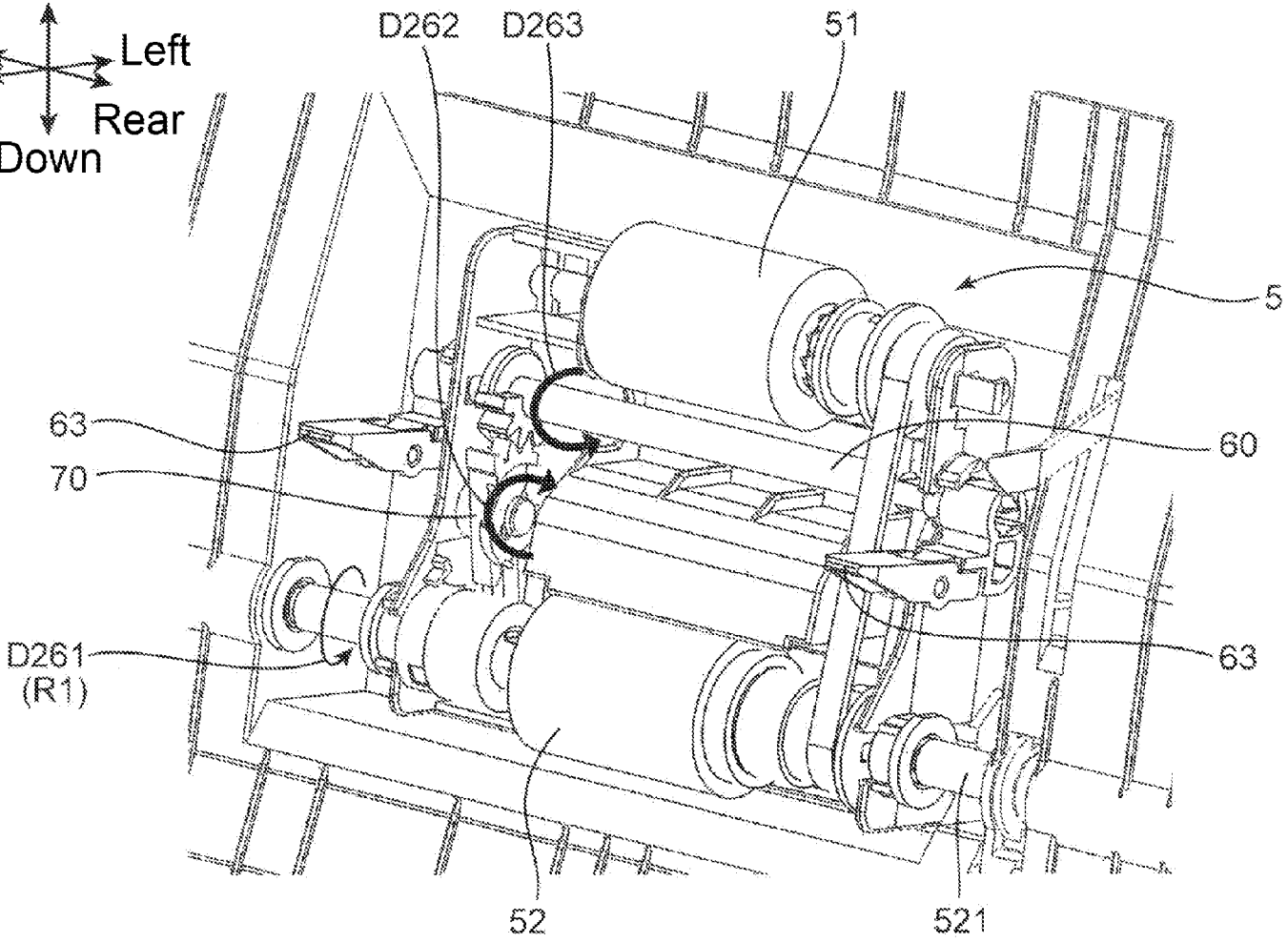
FIG. 26 perspectively illustrates the enlarged document feeding unit where the cover member is open and the stopper projects in the automatic document feeding apparatus according to the one embodiment.
Figure 27:
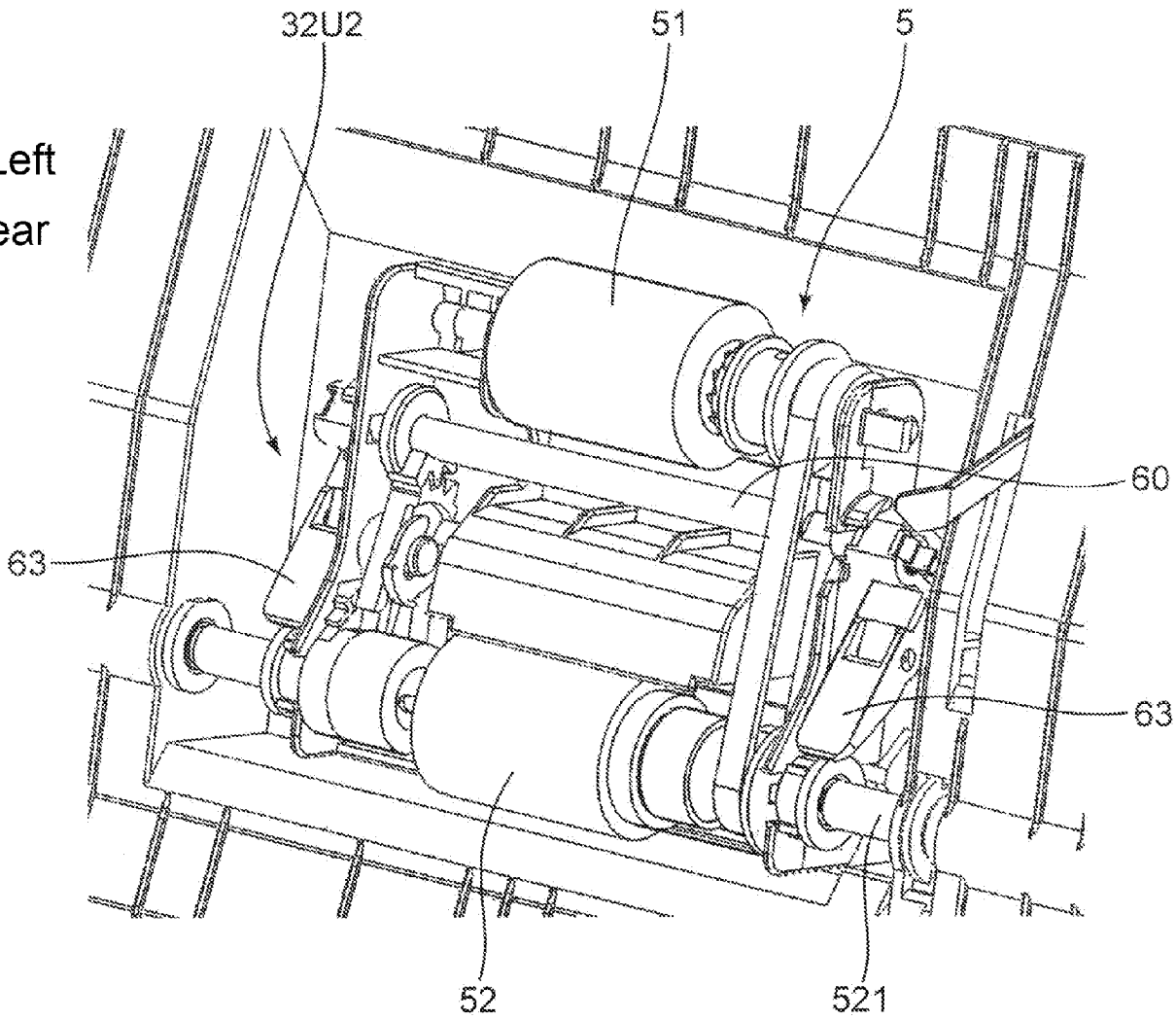
FIG. 27 perspectively illustrates the enlarged document feeding unit where the cover member is open and the stopper evacuates in the automatic document feeding apparatus according to the one embodiment.

FIGS. 21 and 22 illustrate cross sections for a motion of the unit gear 321 in association with the opening of the upper cover unit 32U. FIGS. 21 and 22 illustrate cross sections viewing the unit gear 321 from rearward. FIG. 23 illustrates an enlarged cross section of a part of FIG. 22 to show the motion of the unit gear 321. FIGS. 24 and 25 illustrate front views of the automatic document feeding apparatus 3A where the upper cover unit 32U is open. FIG. 24 illustrates a state where the stopper 63 takes the projection posture while FIG. 25 illustrates a state where the stopper 63 takes the evacuation posture. Further, FIG. 26 perspectively illustrates the enlarged periphery of the document feeding unit 5 in the state of FIG. 24. FIG. 27 perspectively illustrates the enlarged periphery of the document feeding unit 5 of FIG. 25.

In the first conveyance path 341 and the second conveyance path 342 of the automatic document feeding apparatus 3A, when the document sheet P is clogged and the upper cover unit 32U is open, if the stopper 63 remains fixed at the projection posture as illustrated in FIG. 24, the user attempting to remove the clogged document sheet P may incorrectly touch the stopper 63. This may result in damage of the stopper 63. To prevent the damage of the stopper 63, this embodiment includes the automatic document feeding apparatus 3A with an engagement projection 322 (see FIG. 19) (evacuation mechanism). In conjunction with the change from the closed state to the open state of the upper cover unit 32U, the engagement projection 322 causes the stopper 63 to have the evacuation posture or a posture changeable state where the stopper 63 can change from the projection posture to the evacuation posture by application of external force.

With reference to FIG. 19, the engagement projection 322 is a projection projecting from the rear wall portion 302 opposed to the drive housing portion MH. In this embodiment, the engagement projection 322 projects rightward at rearward and upward of the unit gear 321. The engagement projection 322 projects from the rear wall portion 302 of the main body housing 30 on a turning orbit of the unit gear 321 in association with the open/close operations of the upper cover unit 32U.

With reference to FIG. 21, when the upper cover unit 32U is closed to the main body housing 30, the unit gear 321 is arranged above the output gear 401. In this state, when the upper cover unit 32U is started to be open as indicated by an arrow D21, the unit gear 321 moves up and approaches the engagement projection 322. Then, as illustrated in FIGS. 22 and 23, when the engagement projection 322 abuts on one of an engaging pin 321P1 among the engaging pin 321P, the unit gear 321 rotates around the feed roller shaft 521 as indicated by an arrow D22 in FIG. 22 and an arrow D231 in FIG. 23. The rotation direction of the unit gear 321 in this respect corresponds to the above-described first direction (arrow R1 in FIGS. 6B and 7). In association with the open operation of the upper cover unit 32U, the unit gear 321 keeps moving up (arrow D232 in FIG. 23). In association with the rotation of the unit gear 321 around the feed roller shaft 521 (arrow D261 in FIG. 26), the feed roller 52 rotates in the first direction (arrow R1 in FIGS. 6B and 7). Further, by the rotation of the abutting portion 541 (see FIG. 8) of the torque limiter 54 similarly in the first direction, the stopper 63 takes the evacuation posture (see FIG. 27) by the above-described operation of the interlocking portion 8 (arrows D262 and D263 in FIG. 26). Then, the unit housing portion 32U2 houses the stopper 63 taking the evacuation posture. Thus, in this embodiment, in conjunction with the change of the upper cover unit 32U from the closed state to the open state, the engagement projection 322 causes the feed roller 52 to rotate in the first direction, thus the interlocking portion 8 causing the stopper 63 to take the evacuation posture. This prevents the user from touching the stopper 63 projected from the open upper cover unit 32U, preventing the damage of the stopper 63. In this respect, when the upper cover unit 32U is open, the function of the interlocking portion 8 can set the stopper 63 to the evacuation posture.

As described above, the stopper 63 is turnable within a predetermined range centering the turning pivot portion 64 (see FIG. 7). Accordingly, due to the momentum when opening the upper cover unit 32U and the own weight of the stopper 63, the upper cover unit 32U may be open with the stopper 63 projected as illustrated in FIG. 26. However, even in this case, in association with the open operation of the upper cover unit 32U, the unit gear 321 is rotated in the first direction. Accordingly, the abutting portion 541 of the torque limiter 54, the second gear unit 75 of the lever 70, and the first gear unit 60B of the lever shaft 60 are arranged at the positions corresponding to the evacuation posture illustrated in FIG. 16. Accordingly, when the user touches the stopper 63, the stopper 63 is easily rotated around the turning pivot portion 64, taking the evacuation posture illustrated in FIG. 27. In other words, in conjunction with the change of the upper cover unit 32U from the closed state to the open state, the engagement projection 322 causes the feed roller 52 to rotate in the first direction. This applies the external force to the interlocking portion 8, thus the stopper 63 has the posture changeable state where the stopper 63 can be changed from the projection posture to the evacuation posture.

Further, in this embodiment, when opening the upper cover unit 32U, the engagement projection 322 abuts on the engaging pin 321P. This ensures rotating the unit gear 321 in the first direction. In this respect, comparing with the case where the engagement projection 322 abuts on the gear teeth of the outer periphery gear unit 321G of the unit gear 321, the damage of the gear teeth can be prevented. The plurality of engaging pins 321P are arranged along the circumferential direction. This ensures reliably rotating the unit gear 321 in the first direction when opening the upper cover unit 32U.

As described above, the automatic document feeding apparatus 3A according to the above-described embodiment, and the image reading apparatus 3 and the image forming apparatus 1 with the automatic document feeding apparatus 3A can reliably achieve the change of the posture of the stopper 63 and the maintenance of the posture of the stopper 63 according to the rotation and the drive of the feed roller 52. As a result, the document sheets P can be stably conveyed to the image reading position. Moreover, according to a document image read by a reading unit typified by the CIS unit 224, the image can be stably formed on a sheet. Additionally, opening of the upper cover unit 32U with the stopper 63 is reduced while taking the projection posture. Even if the upper cover unit 32U is opened with the stopper 63 taking the projection posture, the posture of the stopper 63 can be easily changed to the evacuation posture. This prevents the damage of the stopper 63. The disclosure is not limited to these embodiments, and, for example, the disclosure can employ the following modifications.

Figure 28:
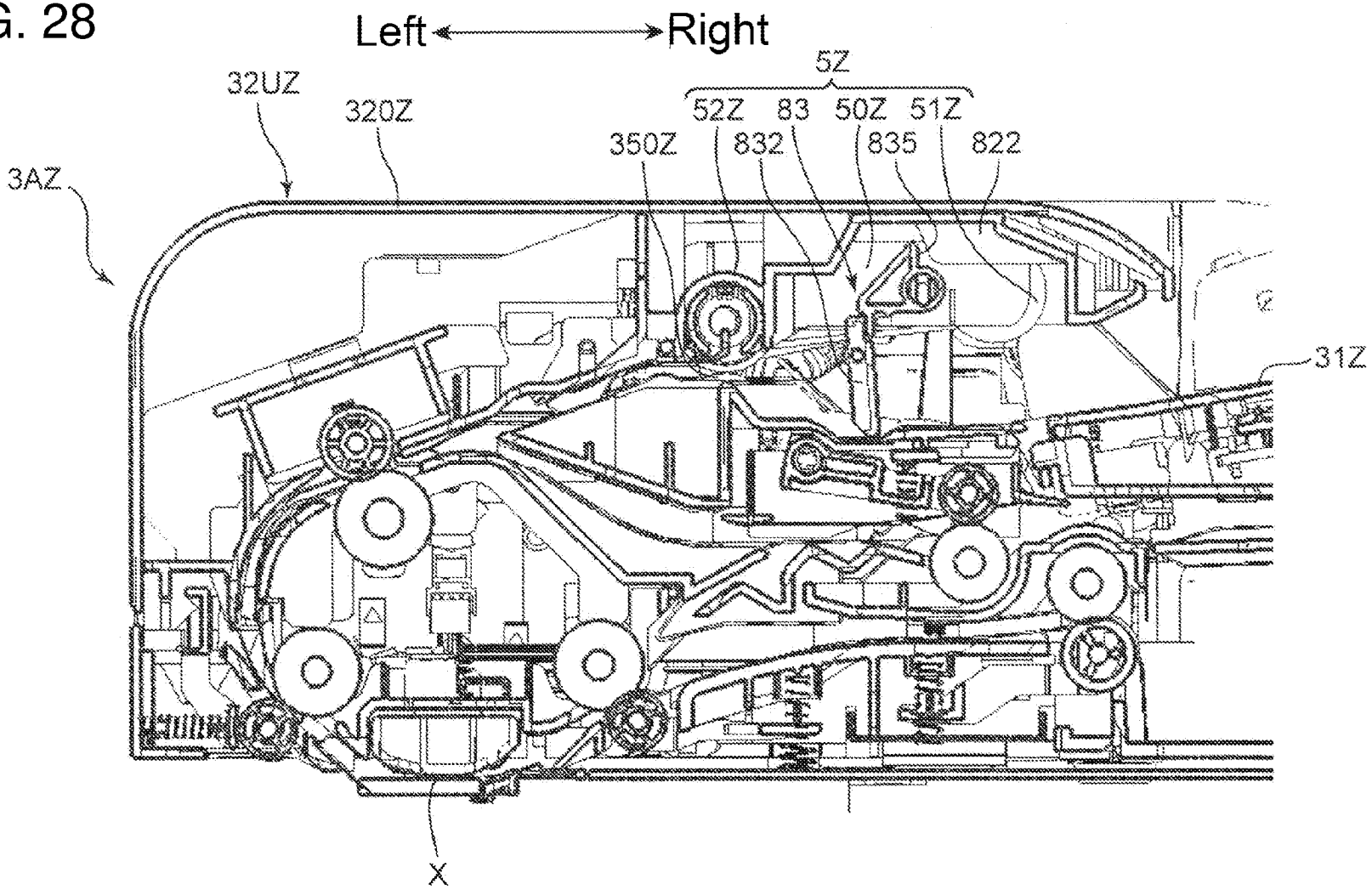
FIG. 28 illustrates a cross section of the document conveying unit that is a main part of an automatic document feeding apparatus according to a modification.
Figure 29:
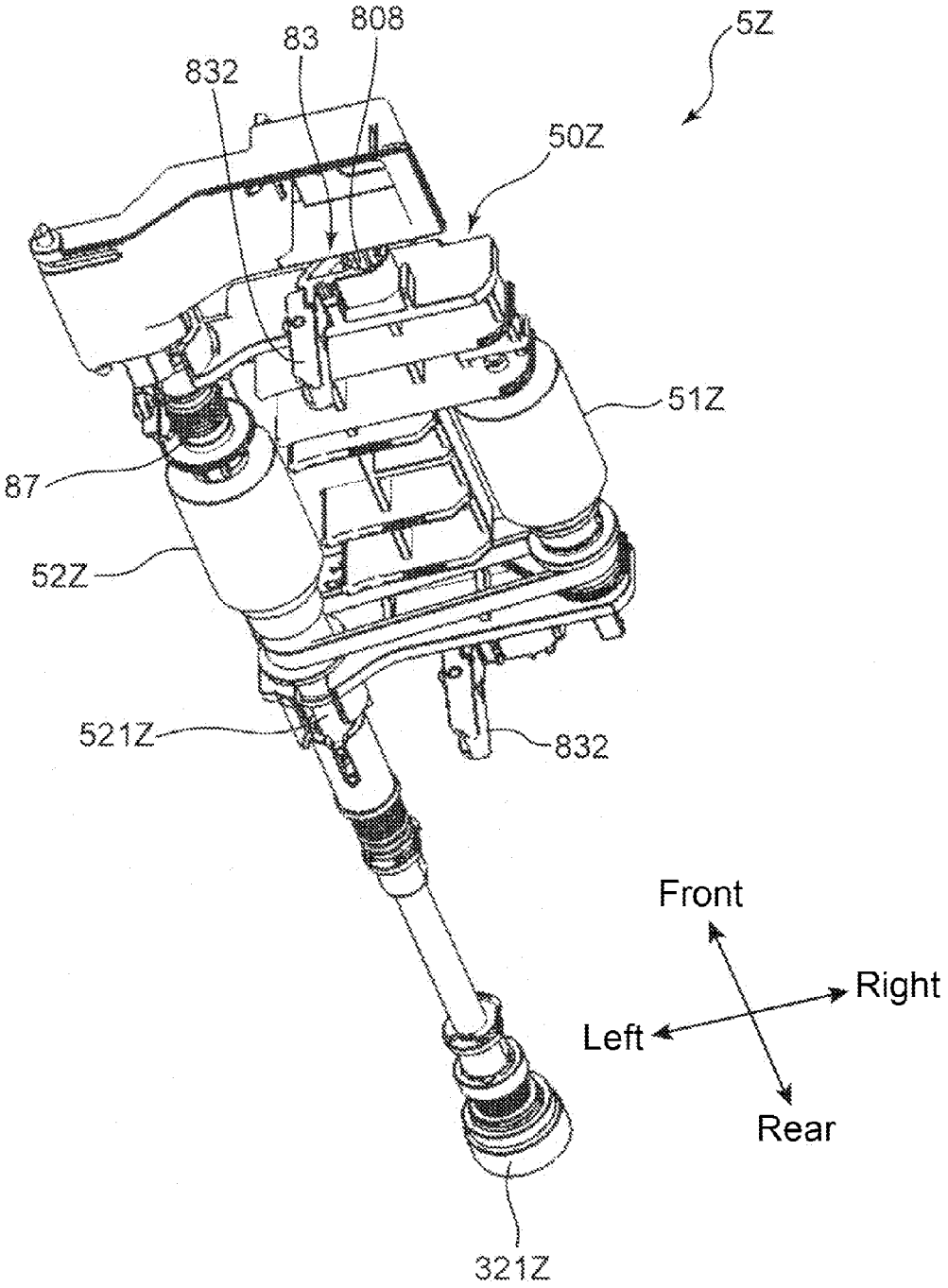
FIG. 29 perspectively illustrates a document feeding unit of the automatic document feeding apparatus according to the modification.
Figure 30:
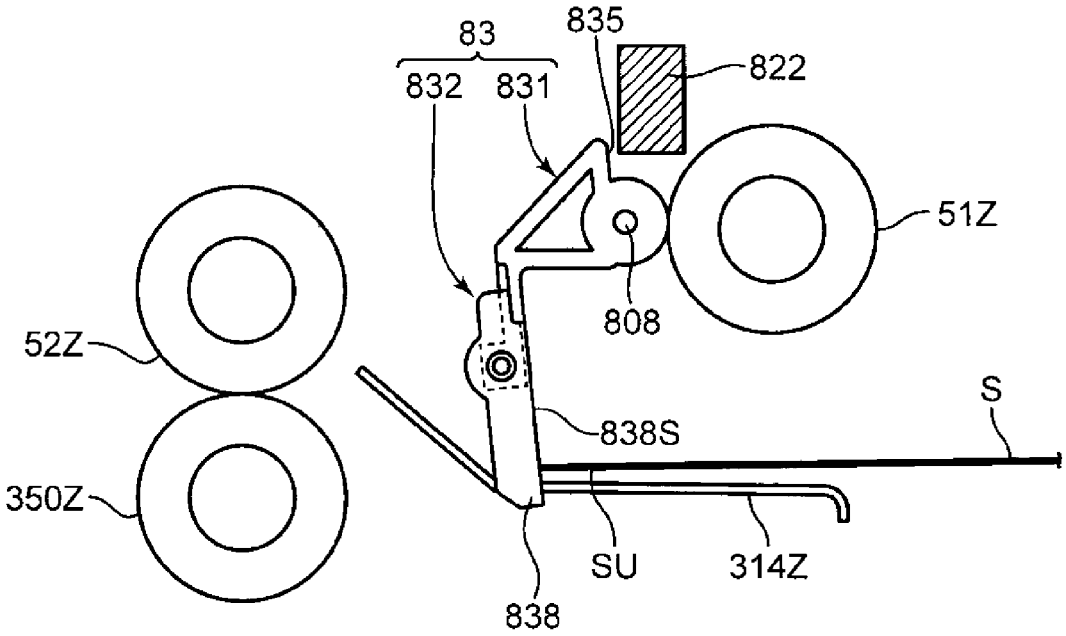
FIG. 30 illustrates a side view of a motion of the stopper of the automatic document feeding apparatus according to a modification.
Figure 31:
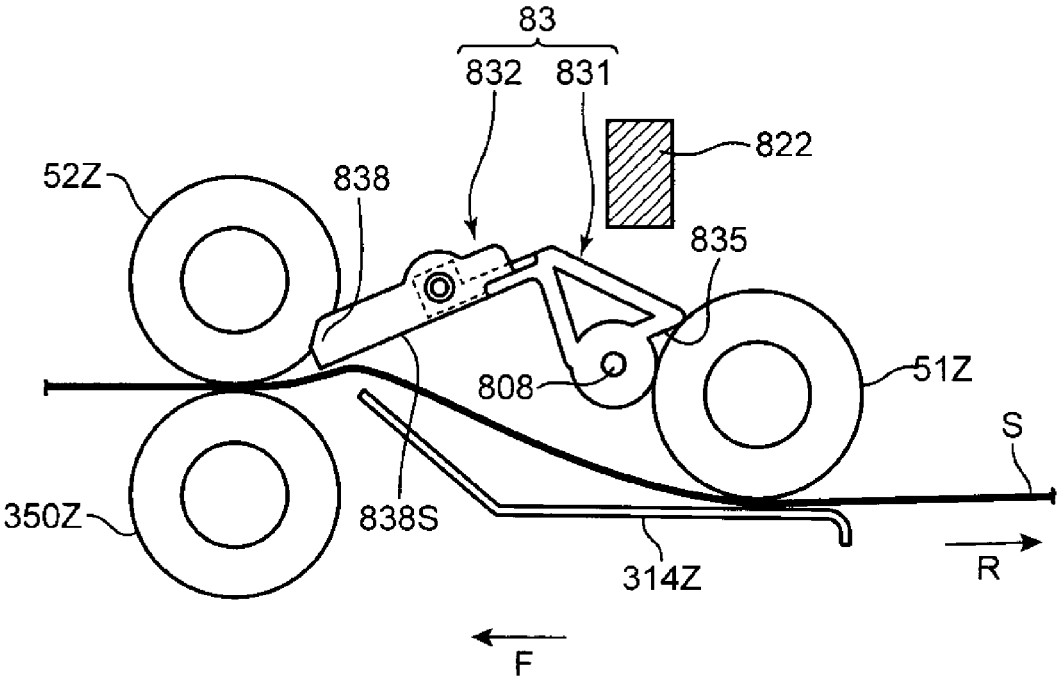
FIG. 31 illustrates a side view of a motion of the stopper of the automatic document feeding apparatus according to a modification.

(1) The above-described embodiments describe the interlocking portion 8 as the mechanism that causes the stopper 63 to appear according to the rotation direction of the feed roller 52; however, the disclosure is not limited to this. FIG. 28 illustrates a cross section of a main part of an automatic document feeding apparatus 3AZ according to a modification. FIG. 29 perspectively illustrates a document feeding unit 5Z according to the modification from the lower surface side. FIGS. 30 and 31 schematically illustrate a side of a stopper mechanism 83 according to the modification. FIG. 30 illustrates a state where a stopper 832 of the stopper mechanism 83 takes the projecting posture while FIG. 31 illustrates a state where the stopper 832 takes the evacuation posture.

The modification differs from the previous embodiments in an aspect of appearance of the stopper 832. Therefore, the following mainly describes the difference and omits the description on other common points. With reference to FIGS. 28 and 29, the document feeding unit 5Z includes a pickup roller 51Z, a feed roller 52Z, the stopper mechanism 83, a holder 50Z, a driving mechanism (not illustrated), and a twisted coil spring 87. The feed roller 52Z is arranged downstream with respect to the pickup roller 51Z in the sheet conveyance direction. The stopper mechanism 83 regulates document sheets placed on the document feed tray 31Z. The holder 50Z holds these members. The driving mechanism swings the holder 50Z and rotates the pickup roller 51Z and the feed roller 52Z. The twisted coil spring 87 provides rotatory power to the holder 50Z. The document feeding unit 5Z is built into an upper cover unit 32UZ. The driving mechanism transmits the rotary drive power to a feed roller shaft 521Z, which is a rotation shaft of the feed roller 52Z. When the paper feeding operation is performed on the document sheets, the rotary drive power is provided to the feed roller shaft 521Z to rotate the feed roller 52Z.

The stopper mechanism 83 is positioned between the pickup roller 51Z and the feed roller 52Z in the lateral direction. The holder 50Z is turnable around the shaft center of the feed roller shaft 521Z. In view of this, when the rotary drive power is provided to the feed roller shaft 521Z in the forward direction, a moment acts on the holder 50Z clockwise viewed from front. As a result, the holder 50Z turns clockwise around the shaft center of the feed roller shaft 521Z, and the pickup roller 51Z moves to the paper feeding position where the pickup roller 51Z contacts the top surface of the document sheet placed on a document feed tray 31Z. In contrast to this, when providing the rotary drive power in the opposite direction (rotary drive power counterclockwise viewed from the front direction) to the feed roller shaft 521Z, a counterclockwise moment acts on the holder 50Z. Accordingly, the holder 50Z turns counterclockwise around the shaft center of the feed roller shaft 521Z. This moves the pickup roller 51Z to a separation position separated above from the top surface of the document sheet. FIG. 28 illustrates a state where the pickup roller 51Z is at the separation position.

A coil portion of the twisted coil spring 87 (see FIG. 29) is inserted through the feed roller shaft 521Z. The twisted coil spring 87 biases the holder 50Z such that the pickup roller 51Z maintains the separation position. Biasing force of the twisted coil spring 87 is set smaller than the clockwise moment generated in the holder 50Z when the rotary drive power is provided to the feed roller shaft 521Z in the forward direction. Therefore, when the feed roller shaft 521Z rotates in the forward direction during feeding of the document sheet, the holder 50Z turns clockwise around the shaft center of the feed roller shaft 521Z against the biasing twisted force of the coil spring 87. On the other hand, when the rotary drive power in the opposite direction is provided to the feed roller shaft 521Z to move the pickup roller 51Z to the separation position, the posture of the holder 50Z at the time is maintained by the biasing force of the twisted coil spring 87. A top panel 320Z of the upper cover unit 32UZ contacts and stops the holder 50Z at the separation position.

The stopper 832 takes the projection posture to regulate the position of the end of a document sheet S in the paper feeding direction. The stopper 832 takes the projection posture as illustrated in FIG. 30 while the pickup roller 51Z is arranged at the separation position, which is separated from the document sheet S, by the swing operation of the holder 50Z. The stopper 832 in the projection posture projects to a downstream end 314Z of the document feed tray 31Z. Then, a regulating surface 838S of an abutting end portion 838 forms a wall surface extending approximately vertical to the document sheets S placed on the document feed tray 31Z. Accordingly, the regulating surface 838S of the abutting end portion 838 can abut on a paper feeding direction end SU of the document sheet S. This regulates the position of the paper feeding direction end SU of the document sheet S, aligning the paper feeding direction end SU. This reduces the oblique document sheet S to be sent out by the pickup roller 51Z.

A first abutting piece 822 (see FIGS. 28 and 30) maintains the projection posture of the stopper 832. The first abutting piece 822 is a rectangular-parallelepiped-shaped projection formed at a top panel 320Z of the upper cover unit 32UZ. While the pickup roller 51Z is arranged at the separation position (see FIG. 30), the top panel 320Z contacts and stops the holder 50Z. The position of the first abutting piece 822 is set such that the first abutting piece 822 can abut on an abutting portion 835 of a support body 831 of the stopper mechanism 83 while the top panel 320Z contacts and stops the holder 50Z.

While the stopper 832 takes the projection posture, if the user places the document sheet S on the document feed tray 31Z and the paper feeding direction end SU is struck to the abutting end portion 838 of the stopper 832, pressing force by the document sheet S acts on the abutting end portion 838. The pressing force by the document sheet S attempts to turn the stopper 832 and eventually the support body 831 clockwise in the front view. However, at this time, the first abutting piece 822 abuts on the abutting portion 835 of the support body 831, preventing the clockwise turn of the support body 831. This maintains the projection posture of the stopper 832.

When the pickup roller 51Z takes a paper feeding posture where the pickup roller 51Z contacts the document sheet S by the swing operation of the holder 50Z as illustrated in FIG. 31, the stopper 832 is changed to the evacuation posture from the projection posture illustrated in FIG. 30. When the rotary drive power is transmitted to the feed roller shaft 521Z and the holder 50Z swings such that the pickup roller 51Z takes the paper feeding posture, that is, when a right end of the holder 50Z moves down, the abutting portion 835 of the support body 831 of the stopper mechanism 83 separates from the first abutting piece 822 of the top panel 320Z. This accepts the clockwise turning of the support body 831. When the rotation operation of the pickup roller 51Z starts feeding the document sheet S, the stopper 832 is pushed upward to the paper feeding direction end SU of the document sheet S to be fed and turns clockwise. Thus, the abutting end portion 838 is separated from the paper feeding direction end SU. This releases the regulation of the paper feeding direction end SU by the abutting end portion 838. The clockwise turning operation of the stopper 832 is enabled by the support body 831 whose clockwise turning has been accepted. At this time, the abutting end portion 838 faces the direction that the document sheet S is conveyed from the pickup roller 51Z to the feed roller 52Z to the extent that feeding of the document sheet S is not hindered. When conveying the document sheet S, the abutting end portion 838 is on a sheet conveying path. The document sheet S is conveyed while sliding to the abutting end portion 838.

Even with the document feeding unit 5Z, when opening the upper cover unit 32UZ, a projection similar to the above-described engagement projection 322 causes the feed roller shaft 521Z to rotate in the first direction (direction of paper feeding by the feed roller 52Z). This turns the holder 50Z around the feed roller shaft 521Z to separate the abutting portion 835 of the support body 831 of the stopper mechanism 83 from the first abutting piece 822 of the top panel 320Z. Consequently, by the own weight of the stopper mechanism 83, the stopper 832 takes the evacuation posture illustrated in FIG. 31. Accordingly, the stopper 832 does not project at the open upper cover unit 32UZ, preventing the damage of the stopper 832. In this modification, the holder 50Z, the first abutting piece 822, the twisted coil spring 87, and the abutting portion 835 function as an interlocking portion. In this modification as well, even if the upper cover unit 32UZ is opened while the stopper 832 taking the projection posture, applying the external force to the stopper 832 turns the stopper 832, ensuring easily changing the posture of the stopper 832 to the evacuation posture.

(2) The above-described embodiments describe the feed roller 52 or the feed roller 52Z as a sheet feeding member that is arranged at the inlet side of the sheet conveying path and conveys the sheet; however, the disclosure is not limited to this. The sheet feeding member may be a belt member to be rotated.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet conveyance apparatus, comprising:

a housing;

a sheet loading portion arranged in the housing, a sheet being to be loaded on the sheet loading portion;

a sheet conveyance path that extends from the sheet loading portion in the housing, the sheet being to be conveyed in a predetermined conveyance direction through the sheet conveyance path;

a sheet feeding member arranged at an inlet side of the sheet conveyance path;

a driving mechanism configured to rotate the sheet feeding member in a first direction and a second direction, the second direction being an opposite direction to the first direction, wherein the sheet feeding member is configured to convey the sheet in the conveyance direction by being rotated in the first direction;

a stopper, upstream of the sheet feeding member in the conveyance direction, configured to change posture between a projection posture and an evacuation posture, the projection posture being configured to project into the sheet conveyance path so as to prevent the sheet to be loaded on the sheet loading portion from abutting on the sheet feeding member, the evacuation posture being configured to evacuate the stopper from the sheet conveyance path;

an interlocking portion configured to fix the stopper in the projection posture or the evacuation posture in conjunction with the rotation of the sheet feeding member, the interlocking portion therein being configured to cause the stopper to take the projection posture corresponding to rotation of the sheet feeding member in the second direction, and to cause the stopper to take the evacuation posture corresponding to rotation of the sheet feeding member in the first direction;

a cover member that supports the sheet feeding member and the stopper, the cover member being openable/closable to the housing, the cover member in an open state opens the sheet conveyance path to an outside of the housing; and an evacuation mechanism configured to, in conjunction with a change of the cover member from a closed state to the open state, change the stopper to have the evacuation posture, or to be in a posture changeable state where the stopper changes from the projection posture to the evacuation posture by application of external force, and rotate the sheet feeding member in the first direction such that the interlocking portion causes the stopper to change to have the evacuation posture or to be in the posture changeable state.

2. The sheet conveyance apparatus according to claim 1, wherein:

the driving mechanism includes a driving unit arranged in the housing, the driving unit being configured to generate rotary drive power for rotating the sheet feeding member, a rotation shaft rotatably supported by the cover member, the rotation shaft being configured to pivotally support the sheet feeding member and serve as a rotation shaft in the rotation of the sheet feeding member, and a drive gear secured to the rotation shaft, the drive gear being connected to the driving unit in the closed state of the cover member;

in the closed state of the cover member, the rotary drive power is transmitted to the sheet feeding member via the drive gear and the rotation shaft; and the evacuation mechanism is configured to rotate the drive gear in the first direction in conjunction with the change of the cover member from the closed state to the open state.

3. The sheet conveyance apparatus according to claim 2, wherein:

the cover member is openable/closable to the housing by being turned using a cover fulcrum arranged at the housing as a fulcrum; and the evacuation mechanism is an engagement projection that projects from the housing on a turning orbit of the drive gear in association with the open/close operations of the cover member, the evacuation mechanism being configured to abut on the drive gear.

4. The sheet conveyance apparatus according to claim 3, wherein:

the driving unit includes an output gear; and the drive gear includes an outer peripheral portion that includes gear teeth, the gear teeth being configured to engage the output gear, and an engaging pin projecting from a one side surface intersecting with the outer peripheral portion to an axial direction in rotation of the drive gear, the engagement projection abutting on the engaging pin.

5. The sheet conveyance apparatus according to claim 4, wherein the plurality of engaging pins are arranged along a circumferential direction in the rotation of the drive gear.

6. The sheet conveyance apparatus according to claim 2, further comprising:

a holder turnably supported by the cover member using the rotation shaft as a rotational fulcrum; and a supporting shaft running in an extending direction of the rotation shaft, the supporting shaft being rotatably supported by the holder, the supporting shaft supporting the stopper; wherein the interlocking portion includes a torque limiter pivotally supported by the rotation shaft, the torque limiter being rotated integrally with the rotation shaft in the first direction and the second direction at a first rotating torque, the torque limiter idling to the rotation shaft at a second rotating torque greater than the first rotating torque, an abutting piece projecting from the torque limiter in a radial direction in a rotation of the shaft, and a connecting member being abutted on the abutting piece corresponding to the rotation of the rotation shaft in the first and second directions, the connecting member being configured to rotate the supporting shaft in a third direction and a fourth direction, the fourth direction being an opposite direction to the third direction; and in association with the rotation of the supporting shaft in the third direction, the stopper takes the evacuation posture, and in association with the rotation of the supporting shaft in the fourth direction, the stopper takes the projection posture.

7. The sheet conveyance apparatus according to claim 6, further comprising:

a pickup roller rotatably supported by the holder to the supporting shaft at an opposite side from the sheet feeding member, the pickup roller being configured to send out the sheet on the sheet loading portion to the sheet feeding member; and a first protrusion projecting from the holder to an inside of a rotational orbit of the abutting piece; wherein in a state where the abutting piece abuts on the connecting member in association with the rotation of the rotation shaft in the first direction, the abutting piece further abuts on the first protrusion to turn the holder in the first direction around the rotation shaft and cause the pickup roller to abut on the sheet loaded on the sheet loading portion.

8. The sheet conveyance apparatus according to claim 7, further comprising:

a second protrusion that provides a space from the first protrusion in a circumferential direction, the second protrusion projecting from the holder to the inside of the rotational orbit of the abutting piece; wherein in a state where the abutting piece abuts on the connecting member in association with the rotation of the rotation shaft in the second direction, the abutting piece further abuts on the second protrusion to turn the holder in the second direction around the rotation shaft and to separate the pickup roller from the sheet loaded on the sheet loading portion.

9. An image reading apparatus, comprising:

the sheet conveyance apparatus according to claim 1, the sheet conveyance apparatus being configured to convey the sheet as a document; and a reading unit arranged opposed to an image reading position arranged in the sheet conveyance path, the reading unit being configured to read a document image on the sheet.

10. An image forming apparatus, comprising:

the image reading apparatus according to claim 9; and an image forming unit configured to form an image on a sheet according to the document image read by the reading unit.

* * * * *